US005457004A

United States Patent [19]

Mooberry et al.

[11] Patent Number: 5,457,004

[45] Date of Patent: Oct. 10, 1995

[54] PHOTOGRAPHIC ELEMENT CONTAINING A HIGH DYE-YIELD COUPLER WITH METHINE DYE CHROMOPHORE

[75] Inventors: Jared B. Mooberry; James J. Seifert; David Hoke, all of Rochester; Zheng Z. Wu, Penfield; David T. Southby, Rochester; Frank D. Coms, Fairport, all of N.Y.

[73] Assignee: Eastman Kodak Company, Rochester, N.Y.

[21] Appl. No.: 250,744

[22] Filed: May 27, 1994

[51] Int. Cl.[6] ..... G03C 7/305; G03C 7/333

[52] U.S. Cl. ..... 430/226; 430/359; 430/549; 430/557; 430/563; 430/955

[58] Field of Search ..... 430/226, 557, 430/559–563, 359, 549, 955, 957

[56] References Cited

U.S. PATENT DOCUMENTS

| | | | |
|---|---|---|---|
| 4,840,884 | 6/1989 | Mooberry et al. | 430/226 |
| 5,008,181 | 4/1991 | Ikegawa et al. | 430/576 |

FOREIGN PATENT DOCUMENTS

| | | | |
|---|---|---|---|
| 3293545 | 11/1988 | Japan | 430/549 |

*Primary Examiner*—Lee C. Wright
*Attorney, Agent, or Firm*—Arthur E. Kluegel

[57] ABSTRACT

The invention provides a photographic element comprising a substrate bearing a photographic silver halide emulsion layer having associated therewith a high dye-yield coupler having the formula:

wherein:

COUP is a photographic coupler residue capable of coupling with oxidized color developer to form a first dye;

T is a timing group;

m is an integer from 0 to 2;

L is a linking group selected from the group consisting of —OC(=O)—, —OC(=S)—, —SC(=O)—, —SC(=S)—, and —OC(=$NSO_2R$) where R is substituted or unsubstituted alkyl or aryl; and DYE is a releasable second dye or dye precursor having a particular formula including a methine dye chromophore.

67 Claims, No Drawings

PHOTOGRAPHIC ELEMENT CONTAINING A HIGH DYE-YIELD COUPLER WITH METHINE DYE CHROMOPHORE

FIELD OF THE INVENTION

The invention relates to photographic silver halide materials which incorporate a high dye-yield coupler which contains a particular methine chromophore.

BACKGROUND OF THE INVENTION

Conventional silver halide color photography depends upon the formation of dyes by the oxidative coupling of coupler compounds with oxidized developer compound that is generated by the reduction of silver halide during development. Often, to improve coupler efficiency, the coupler compound is provided with a coupling-off group to enable the coupler to form a dye with the concomitant theoretical consumption of only two rather than four moles of silver halide. Unless of the "wash-out" variety, the coupling-off group can remain in the photographic element subsequent to processing and should have little or no deleterious effect on the resulting image.

It has been known to employ a releasable dye or dye precursor as the coupling-off group to provide a so-called "high dye-yield" coupler and to thus improve the theoretical efficiency of the coupler. In such a manner, the coupler can provide two dye molecules instead of one. Further efficiency improvements in silver usage can thus be envisaged.

Useful high dye-yield (HDY) couplers have been disclosed by Mooberry and Singer in U.S. Pat. No. 4,840,884. Such couplers react with oxidized color developer to form one dye and in doing so release a second dye or a precursor of a second dye. In accordance with the patent, the new couplers described therein enable lower concentrations of silver halide in the photographic element without lowering image quality. It has been found, however, that the high dye-yield couplers taught in the Mooberry patent exhibit a number of disadvantages. The azo dye releasing couplers of the patent provide improvements in dye-forming efficiency over that obtained from conventional couplers but not to the extent necessary to justify the increased manufacturing costs associated with the manufacture of such couplers. Moreover, the characteristics of the dye formed by release are less than desired. Yellow azo dyes provide extinctions in the neighborhood of 30,000 compared to 20,000 for the azamethine dyes formed by the conventional yellow coupler. However, these extinctions are less than desired and the azo dyes generally exhibit broader absorption bandwidths which result in inferior hue.

Methine dyes provide corresponding extinctions in the neighborhood of 50,000 and can therefore provide more density if hue and stability problems can be overcome. Examples 3 through 6 of the Mooberry patent suggest methine dye chromophores for the released second dye but the features obtainable with the particular dyes suggested are less than desired. The exemplified couplers do not provide the optimum features of coupler stability and satisfactory dye hue.

It is a problem to be solved to provide a photographic element that incorporates a high dye-yield coupler that exhibits the desired features of coupler stability and satisfactory dye hue.

SUMMARY OF THE INVENTION

The invention provides a photographic element comprising a substrate bearing a photographic silver halide emulsion layer having associated therewith a high dye-yield coupler having the formula:

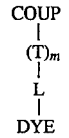

wherein:

COUP is a photographic coupler residue capable of coupling with oxidized color developer to form a first dye;

T is a timing group;

m is an integer from 0 to 2;

L is a linking group selected from the group consisting of —OC(=O)—, —OC(=S)—, —SC(=O)—, —SC(=S)—, and —OC(=$NSO_2R$) where R is substituted or unsubstituted alkyl or aryl;

DYE is a releasable second dye or dye precursor having a desired wavelength range of light absorption, wherein DYE has the formula:

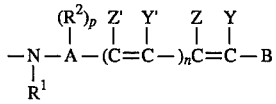

wherein $R^1$ is hydrogen or a substituted or unsubstituted alkyl or aryl (including heteroaryl) group;

A is a substituted or unsubstituted aryl (including heteroaryl) ring;

each $R^2$ is independently a substituted or unsubstituted alkyl group which may form a ring with Z' or Z when n=0;

p is an integer from 0 to 3;

each Z, Z', and Y' is independently hydrogen or a substituent;

Y is an electron withdrawing group;

n is 0, 1, or 2; and

B is a heterocycle having the formula:

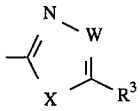

wherein:

X is O,S, or N($R^5$) where $R^5$ is hydrogen or alkyl;

W is N or C($R^4$) where $R^4$ is hydrogen or a substituent;

$R^3$ is a substituent linked to the heterocycle by a carbon or nitrogen atom of the substituent;

provided that $R^3$ and $R^4$ may be linked to form a ring and provided further that when $R^3$ and $R^4$ form a phenyl ring, Z is hydrogen, W is C($R^4$), and X is oxygen, the phenyl ring does not contain a substituent having a Hammett's sigma(para) value of 0.23 or more.

The invention also provides a novel coupler compound and a process for forming an image using the photographic element of the invention.

The invention provides a photographic element that incorporates a high dye-yield coupler that exhibits the desired features of coupler stability and satisfactory dye hue.

DETAILED DESCRIPTION OF THE INVENTION

As described in the preceding summary of the invention, the high dye-yield coupler of the invention has the formula:

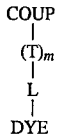

where COUP is the parent group of the coupler capable of reacting at the coupling position with oxidized color developer to form a first dye, T is one or two optional timing groups, which may be the same or different, m is an integer from 0 to 2, L is one of a specified set of linking groups, and DYE is a releasable second dye or dye precursor which contains a particular methine chromophore.

COUP is the parent portion of a coupler that is capable of coupling with oxidized developer to form a dye. As described more fully hereafter, the dye may be of any desired color or may be colorless and if desired, it may be of the so-called universal type which washes out of the element or is decolorized during processing.

Image dye-forming couplers may be included in the element such as couplers that form cyan dyes upon reaction with oxidized color developing agents which are described in such representative patents and publications as: U.S. Pat. Nos. 2,367,531, 2,423,730, 2,474,293, 2,772,162, 2,895,826, 3,002,836, 3,034,892, 3,041,236, 4,333,999, 4,883,746 and "Farbkuppler-eine LiteratureUbersicht," published in Agfa Mitteilungen, Band III, pp. 156–175 (1961). Preferably such couplers are phenols and naphthols that form cyan dyes on reaction with oxidized color developing agent.

Couplers that form magenta dyes upon reaction with oxidized color developing agent are described in such representative patents and publications as: U.S. Pat. Nos. 2,311,082, 2,343,703, 2,369,489, 2,600,788, 2,908,573, 3,062,653, 3,152,896, 3,519,429, and "Farbkuppler-eine LiteratureUbersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized color developing agent are described in such representative patents and publications as: U.S. Pat. Nos. 2,298,443, 2,407,210, 2,875,057, 3,048,194, 3,265,506, 3,447,928, 4,022,620, 4,443,536, and "Farbkuppler-eine LiteratureUbersicht," published in Agfa Mitteilungen, Band III, pp. 112–126 (1961). Such couplers are typically open chain ketomethylene compounds.

COUP is most suitably capable of forming a yellow dye when coupled with oxidized color developer. Yellow dyes are most readily shifted outside the visible region by the linking group and therefore the formation of two yellow dye molecules from the coupler is attractive. Further, extinctions of conventional yellow dyes are less than desired so that the release of a high extinction yellow dye would serve to greatly improve the density obtainable.

Couplers that form colorless products upon reaction with oxidized color developing agent are described in such representative patents as: U.K. Patent No. 861,138; U.S. Pat. Nos. 3,632,345, 3,928,041, 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dyeformation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

T is a timing group which, as indicated by the value range for m of from 0 to 2, may be absent or may represent one or two such timing groups. Such groups are well-known in the art such as (1) groups utilizing the cleavage reaction of a hemiacetal (U.S. Pat. No. 4,146,396, Japanese Applications 60-249148; 60-249149); (2) groups utilizing an electron transfer reaction along a conjugated system (U.S. Pat. Nos. 4,409,323; 4,421,845; Japanese Applications 57-188035; 58-98728; 58-209736; 58-209738); (3) groups utilizing the cleavage of imino ketals (U.S. Pat. No. 4,546,073); (4) groups that function as a coupler or reducing agent after the coupler reaction (U.S. Pat. Nos. 4,438,193; 4,618,571); and (5) groups using an intramolecular nucleophilic substitution reaction (U.S. Pat. No. 4,248,962). The timing group to which the L-DYE group of the invention is optionally attached is any one which will permit release of the L-DYE group. Foregoing group (5) is not suitable as the group to release L-DYE but could serve as the first of a sequence of two timing groups. Other timing groups are generally suitable for releasing —L-DYE. Timing groups as described under (2) and the listed patents are most suitable. Generally these consist of a bond from COUP or another timing group to an oxygen atom which is bonded to a substituted or unsubstituted aromatic hydrocarbyl or heterocyclic ring at a location in conjugation with a methyl group on the ring which may optionally be substituted with one or two alkyl groups, where the methyl group is bonded to L-DYE or a second timing group. A typical such group based on an aromatic hydrocarbyl group has the formula:

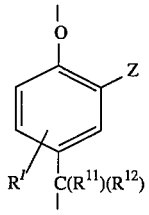

wherein Z is selected from the group consisting of nitro, cyano, alkylsulfonyl; sulfamoyl ($—SO_2NR_2$); and sulfonamido ($—NRSO_2R$) groups; R is hydrogen or a substituent such as alkyl; $R^7$, $R^{11}$ and $R^{12}$ are independently hydrogen or substituents that do not adversely affect the coupling and release reactions or the properties of the dyes formed thereby.

One example of such a group containing an aromatic heterocycle is:

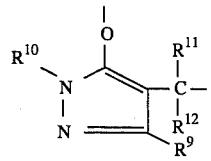

where $R^9$ through $R^{12}$ are independently hydrogen or substituents that do not adversely affect the coupling and release reactions or the properties of the dyes formed thereby.

L is a group which serves to connect COUP (or T, if present) to the second dye. L has a formula so as to permit —L-DYE or —$(T)_m$—L-DYE to be cleaved from the coupler upon the coupler's oxidative coupling with color developer during development processing. COUP combines with the oxidized developer to form the first dye and the fragment —L-DYE or —$(T)_m$—L-DYE is then freed from COUP. Suitable groups for L are —OC(O)—, —OC(S)—, —SC(O)—, —SC(S)—, or —OC(=$NSO_2R$)—, where R is substituted or unsubstituted alkyl or aryl. Such groups permit the cleavage of the fragment from COUP or a timing group, if present, and are cleaved from DYE during processing. Such groups also serve to effect a shifting of the dye hue so that, while the coupler is intact in the photographic element, the coupler will not unduly interfere with the transmission of light through the element.

The coupler of the invention releases a second dye having an electrically neutral chromophore. By this is meant that the chromophore at its characteristic hue bears no formal electrical charge. The second dye of the invention contains a nitrogen atom which is bonded to the linking group. Such dyes may be synthesized as described in the aforementioned U.S. Pat. No. 4,840,884 and as described hereinafter.

In the '884 patent, the term DYE is defined so that the adjacent nitrogen atom is not a part of DYE while the definition of DYE herein does include the nitrogen atom. In either case, the composition of the dye formed by release is the same.

The selection of the type and size of the substituents of DYE can be made in order to provide a partition coefficient of DYE which permits the desired degree of diffusion. The term DYE also includes dye precursors wherein the described substituted nitrogen atom is an integral part of the chromophore, also described herein as leuco dye moieties. Such precursors are described more fully in the '884 patent.

DYE is a releasable second dye or dye precursor having a desired wavelength range of light absorption, wherein DYE has the formula:

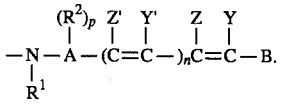

$R^1$ is hydrogen or a substituted or unsubstituted alkyl or aryl (including heteroaryl) group. The $R^1$ substituent can be any substituent that does not adversely affect the coupler. $R^1$ can be, for example, hydrogen or alkyl, such as alkyl containing 1 to 42, typically 1 to 22 carbon atoms. Preferred $R^1$groups are unsubstituted or substituted alkyl, such as alkyl containing 1 to 18 carbon atoms or unsubstituted or substituted aryl, such as phenyl. Suitably, $R^1$ may be methyl, ethyl, propyl, butyl, pentyl, docecyl etc. Cyclic or branched alkyl groups such as isopropyl, cyclopentyl or cyclohexyl have been found advantageous as have alkyl groups of 1 to 5 carbon atoms.

A is a substituted or unsubstituted aryl (including heteroaryl) ring containing up to three optional substituents $R^2$. Suitably, A is a phenyl, naphthyl, or thiazole ring. Each $R^2$ is independently a substituted or unsubstituted alkyl group which may form a ring with Z', and p is an integer from 0 to 3. One or more $R^2$ substituents may be present which preferably include alkyl groups of from 1 to 5 carbon atoms such as a methyl or propyl group.

Each Z, Z', and Y' is independently hydrogen or a substituent. Y is an electron withdrawing group. By electron withdrawing it is meant that the Hammett's sigma(para) constant value for Y is greater than zero. Constant values for various substituents are provided in Hansch and Leo, *Substituent Constants for Correlation Analysis in Chemistry and Biology*, Wiley, New York, 1979. Preferably, Y is a substituent having a Hammett's sigma(para) constant value of at least 0.3 and most preferably at least 0.4. Suitable examples are cyano, carboxyl, sulfonyl, and acyl groups.

n, which represents the number of conjugated vinyl groups and affects the hue of the dye, is 0, 1, or 2.

B is a heterocycle having the formula:

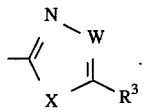

X is O, S, or N($R^5$) where $R^5$ is hydrogen or alkyl of up to 22 carbon atoms. Most suitably, X is O. W is N or C($R^4$) where $R^4$ is hydrogen or a substituent. $R^3$ is a substituent linked to the heterocycle by a carbon or nitrogen atom of the substituent. Suitably, $R^3$ is a substituted or unsubstituted alkyl or aryl group. If desired, $R^3$ and $R^4$ may be linked to form a ring. It is provided that $R^3$ and $R^4$ may be linked to form a ring and provided further that when $R^3$ and $R^4$ form a phenyl ring, Z is hydrogen, W is C($R^4$), and X is oxygen, the phenyl ring does not contain a substituent having a Hammett's sigma(para) value of 0.23 or more. The strong electron withdrawing power of such combination is believed responsible for the instability of couplers bearing such a combination of substituents.

When $R^3$ and $R^4$ form a ring, a substituted or unsubstituted ring, particularly an aromatic ring, may be employed. Phenyl and naphthyl rings are examples. The ring may suitably contain one or more substituents of up to 20 carbon atoms each such as alkyl groups, e.g. methyl, i-propyl, t-butyl etc.

In a preferred embodiment, X is O, W is C($R^4$), and $R^3$ and $R^4$ form a phenyl ring so that B is a benzoxazole group.

The couplers of the invention are particularly suited for the release of yellow dyes. In such case, methine chromophores are preferred over azo's for reasons of higher molar extinction which means less dye weight-wise is needed, narrower bandwidth and better curve shape (better hue, truer color), and less undesired color in the shifted form when attached to the parent coupler.

Decomposition of the coupler in the developer solution leads to magenta stains in the film and is a function of the substituents in the chromophore and overall solubilization of the couplers. Electron withdrawing substituents in the B, especially benzoxazole, ring or other polarization of the central double bond promotes this undesired effect. Hence substituents which are neutral or electron donating (having a Hammett's sigma(para) value of zero or less) such as H, alkyl, or alkoxy are preferred at all appropriate substituent positions in the chromophore. It is preferred to provide at least one $R^2$ substituent larger than H in a position ortho to the double bond because this helps prevent decomposition by sterically hindering developer nucleophiles from attacking the central double bond. Substituents larger than H at other $R^2$ positions can twist the nitrogen auxochrome somewhat out of conjugation with the chromophore and make it more susceptible to decomposition by nucleophiles; at the same time such substitutents may improve the hue shift of the coupler prior to processing. Hydrogen and methyl are generally preferred in these positions.

The hue of the yellow methine dye is shifted into the ultraviolet region when attached to the parent coupler via the electrophilic carbonyl group. Substitution of methyl or methoxyl at the position ortho to the N-auxochrome twists the chromophore in the shifted form as well and gives less colored couplers; however, this is generally an undesirable tradeoff for reasons of synthesis and stability in the case of methoxyl.

Compared to couplers releasing analogous azo dyes, the couplers of the invention provide better extinction, and superior photographic properties such as hue, and are shifted better so that the color of the coupler is minimized. Compared to known methine dye releasing couplers, the couplers of the invention are more stable and provide superior photographic properties such as hue.

The high dye-yield couplers of the invention provide a number of potential advantages. The ability to achieve greater dye formation enables one to reduce the amount of coupler, silver, and gelatin to be included in the film layers. This enables thinner layers which in turn reduces the amount of light scatter to improve sharpness in underlying layers. Thinner layers can also reduce the level of unwanted absorption which can further enhance the image quality in underlying layers. Thus the benefits of the invention are particularly advantageous in the uppermost layers which means the blue sensitive layers in conventional color negative layer arrangements.

The following exemplify couplers suitable for use in the photographic element of the invention:

I-1

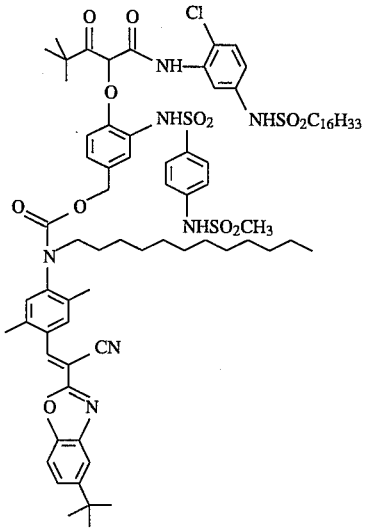

-continued

I-2

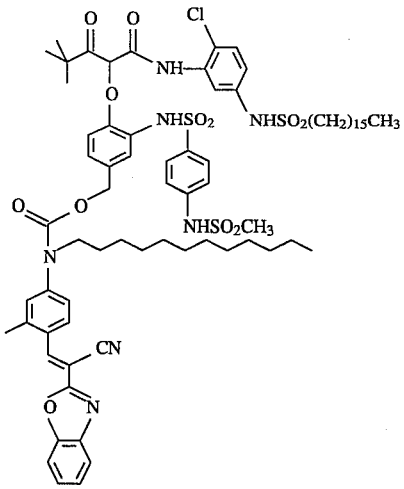

I-3

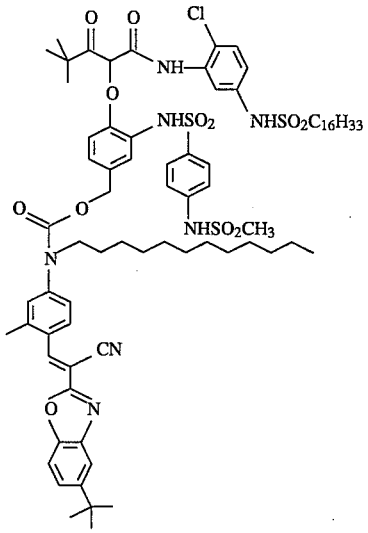

I-4

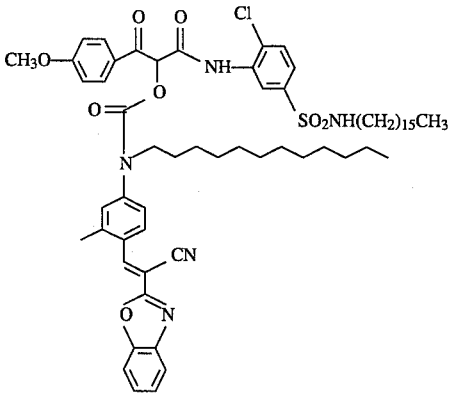

-continued
I-5
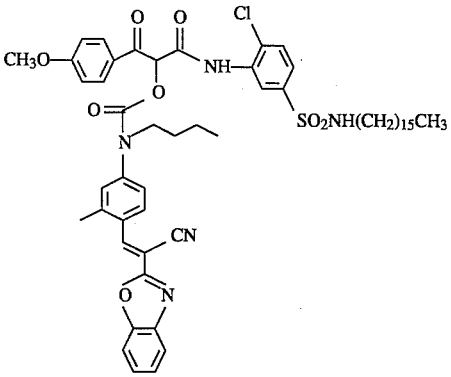
I-6
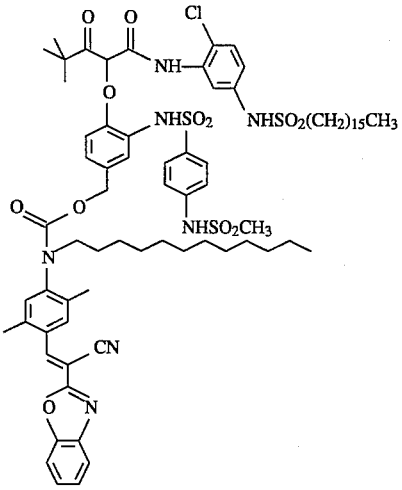
I-7
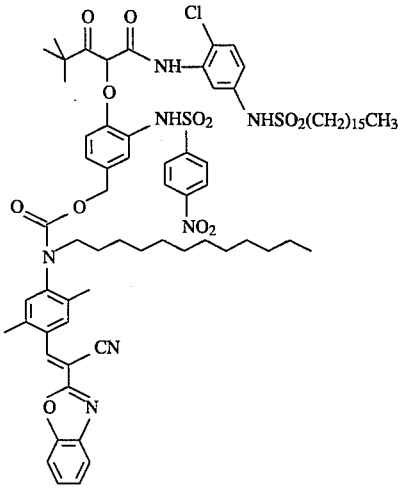
-continued
I-8
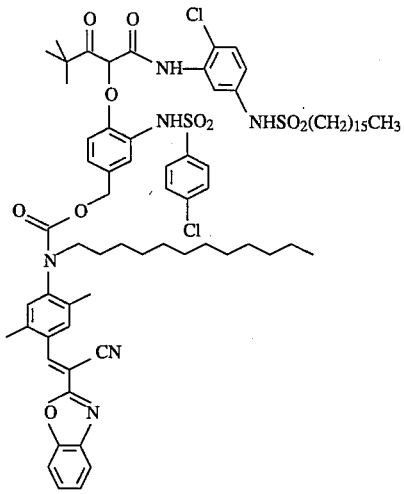
I-9
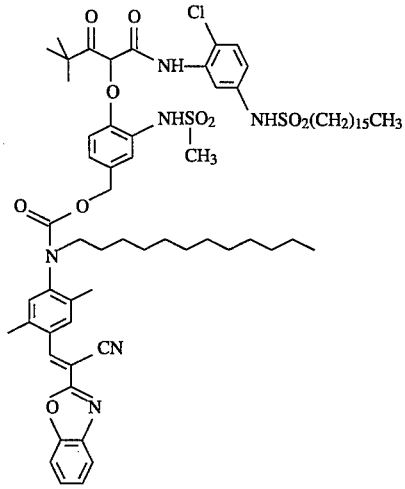
I-10
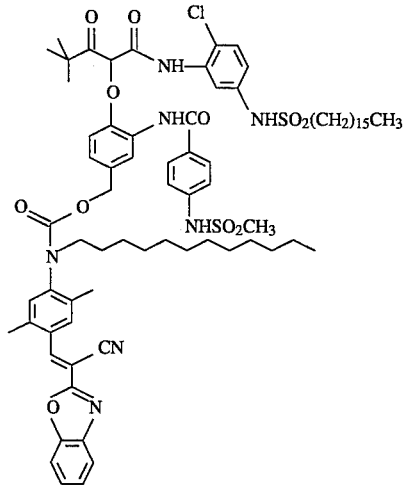

-continued
I-11
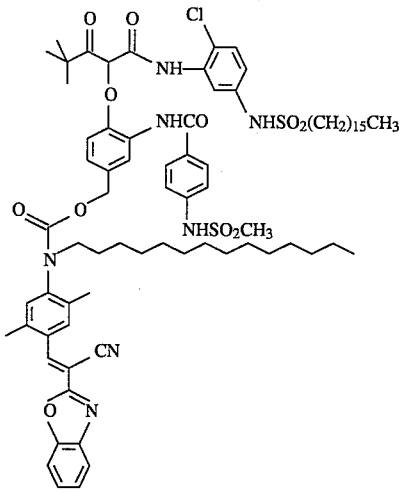
I-12
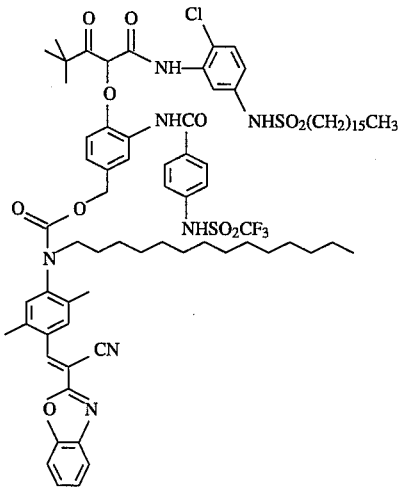
I-13
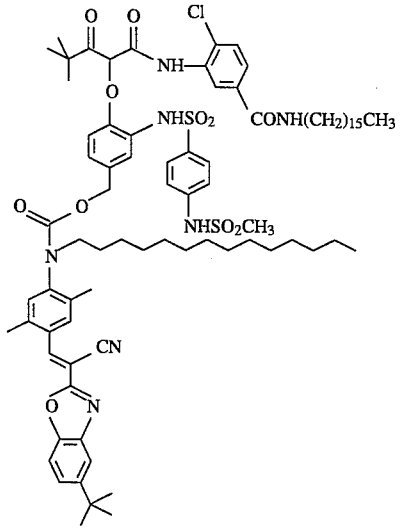
-continued
I-14
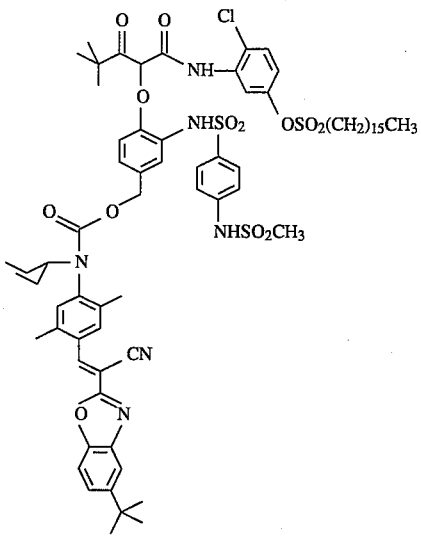
I-15
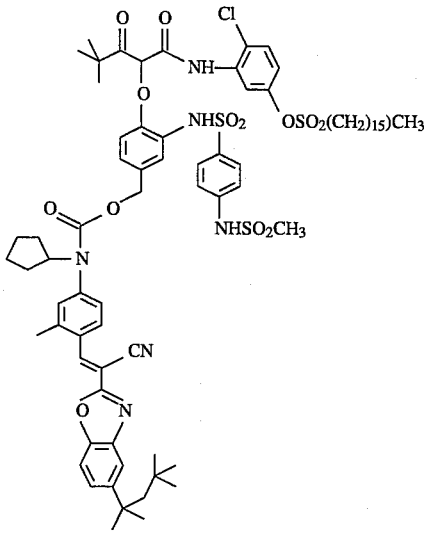
I-16
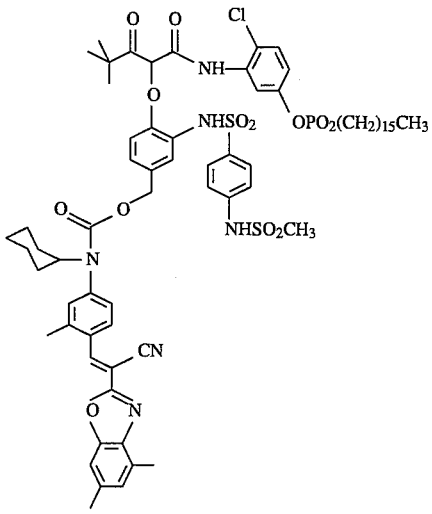

-continued
I-17
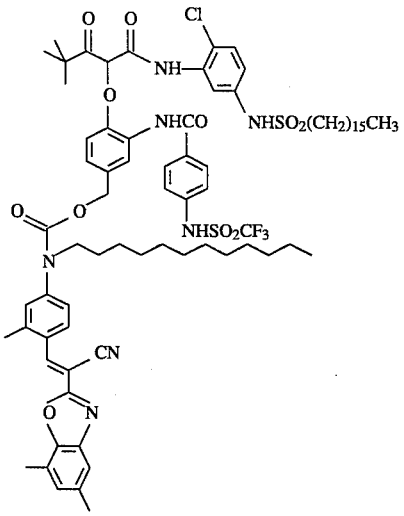
I-18
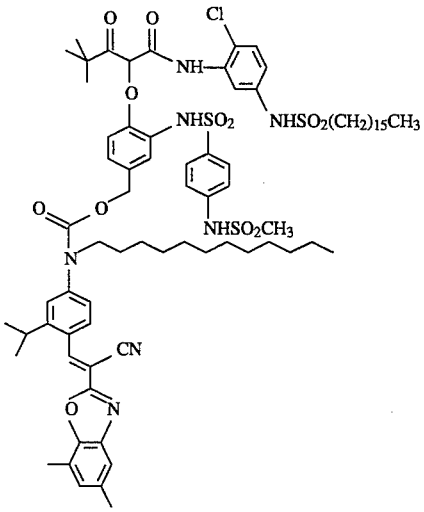
I-19
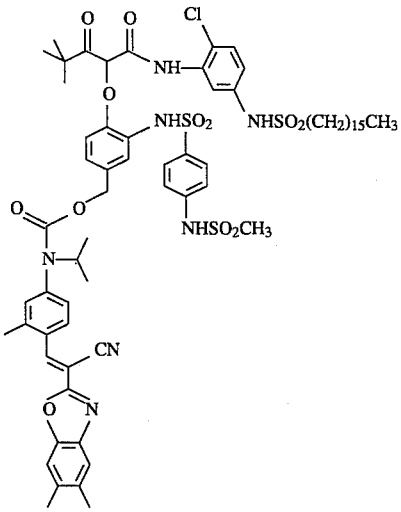
-continued
I-20
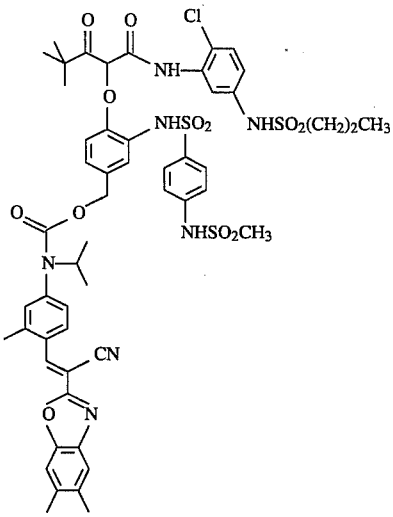
I-21
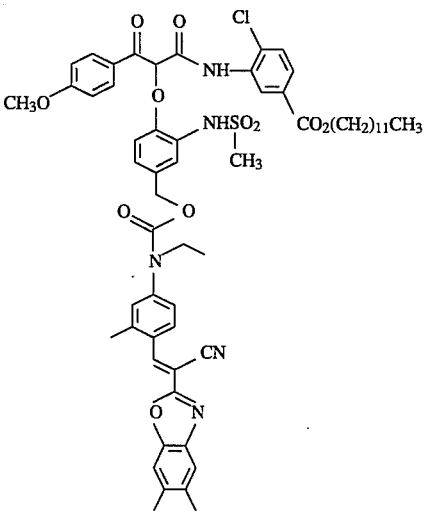
I-22
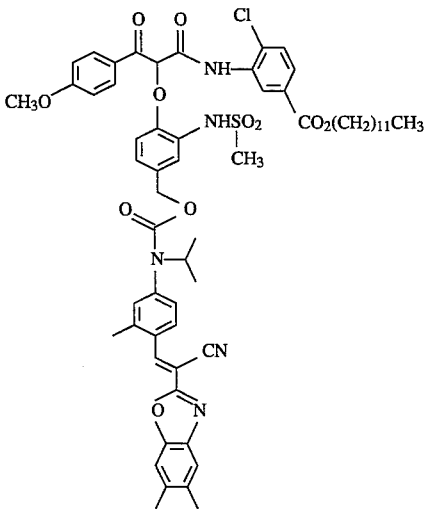

-continued
I-23
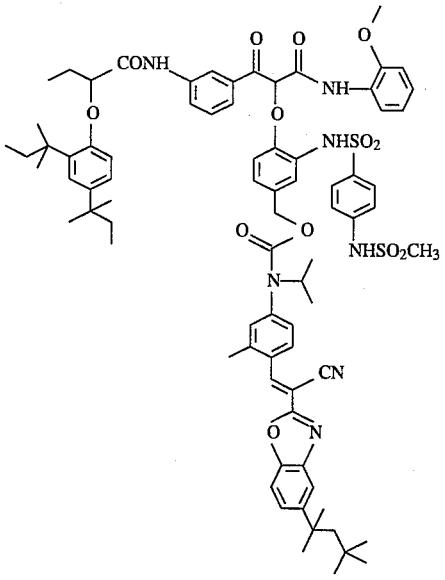
I-24
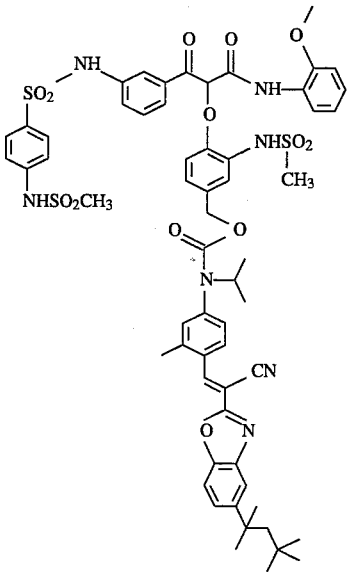
I-25
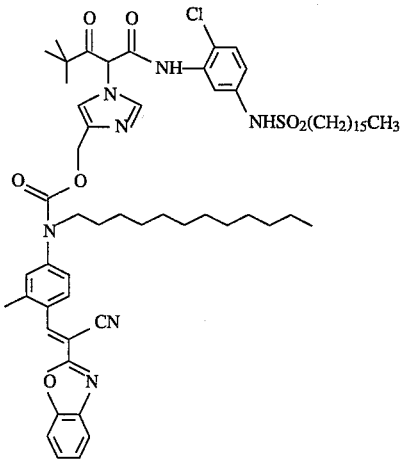
-continued
I-26
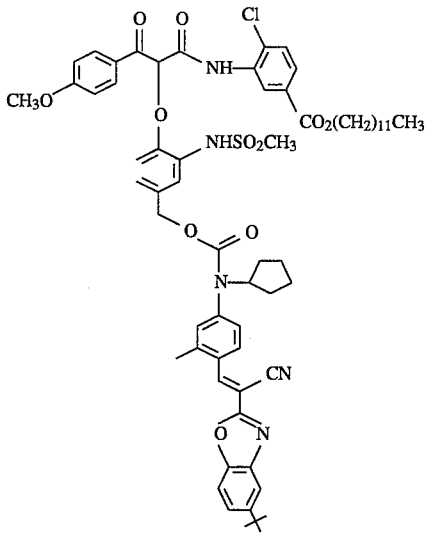
I-27
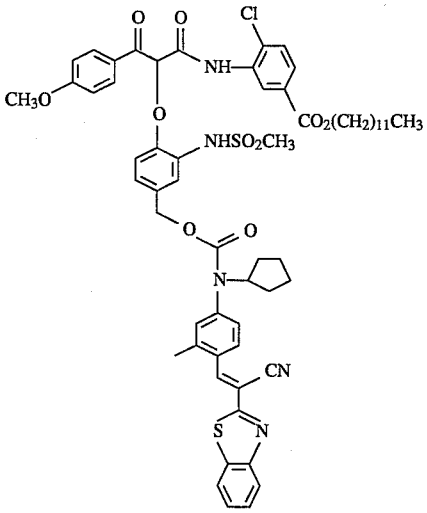
I-28
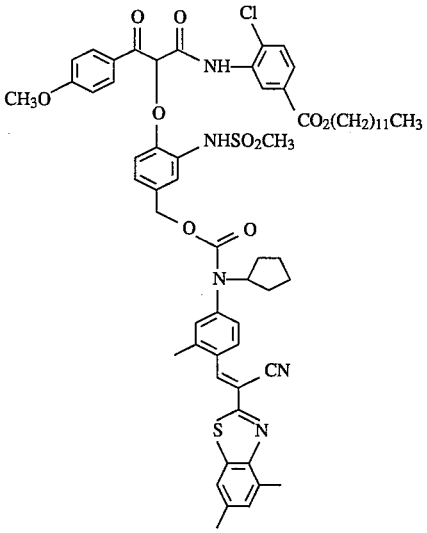

-continued
I-29
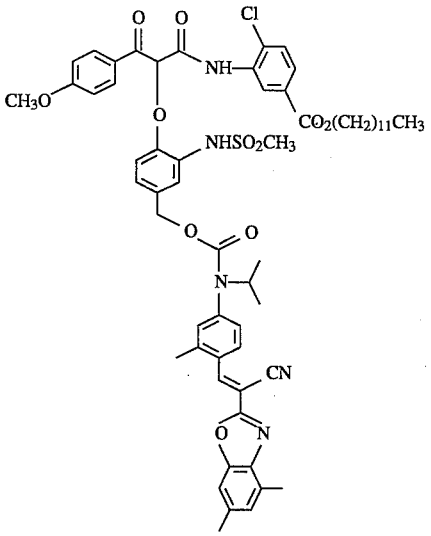
I-30
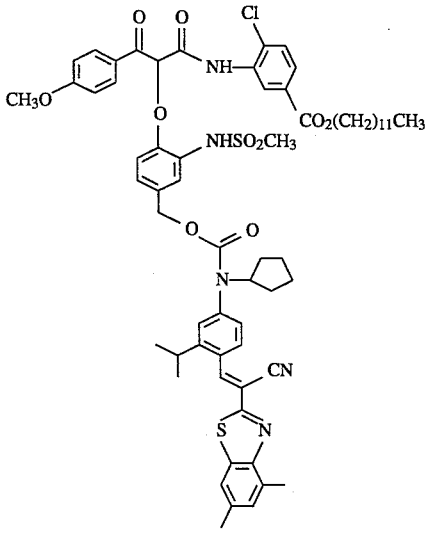
I-31
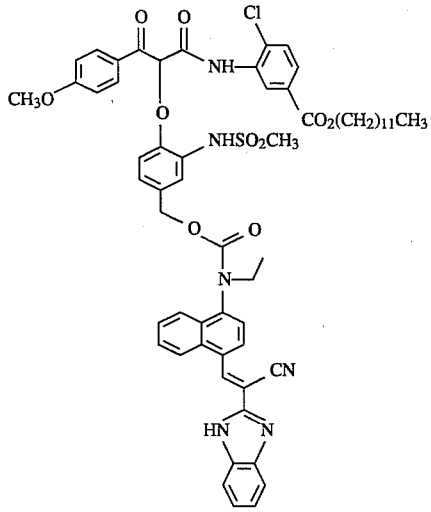
-continued
I-32
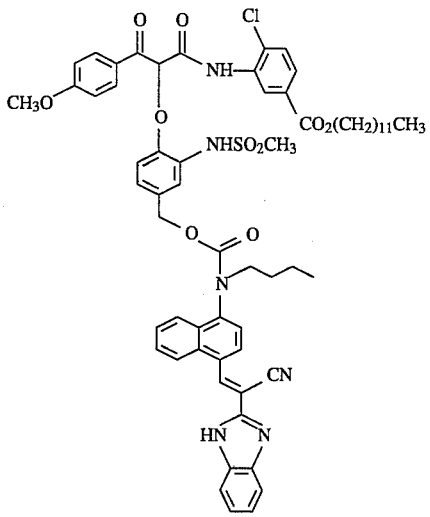
I-33
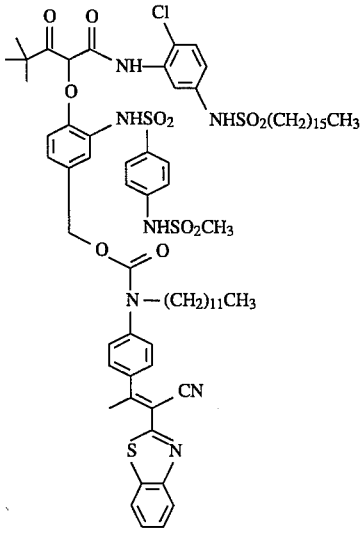
I-34
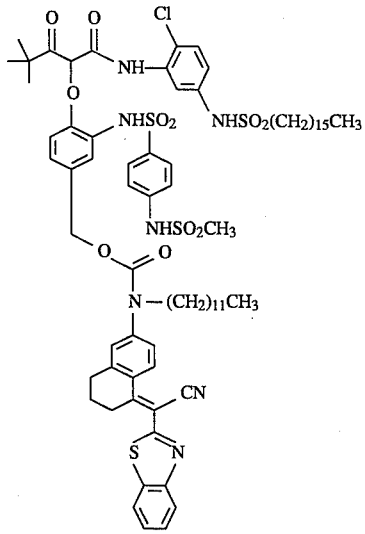

-continued
I-35
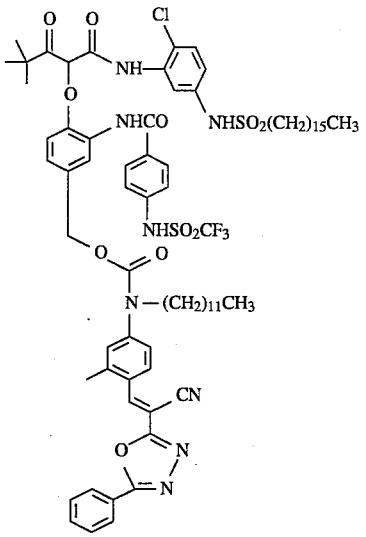
I-36
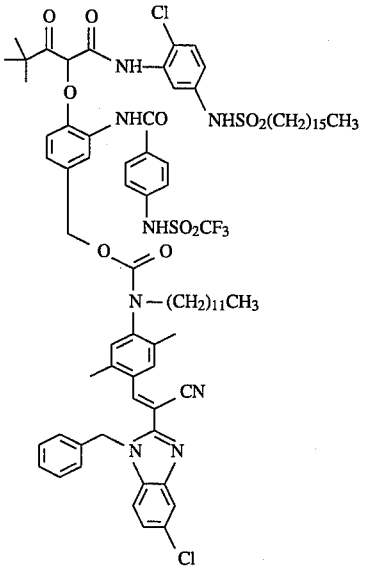
I-37
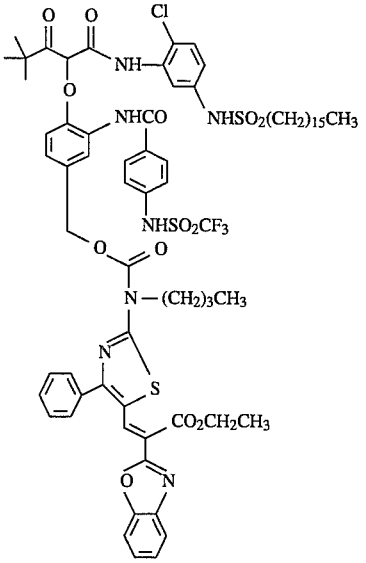
-continued
I-38
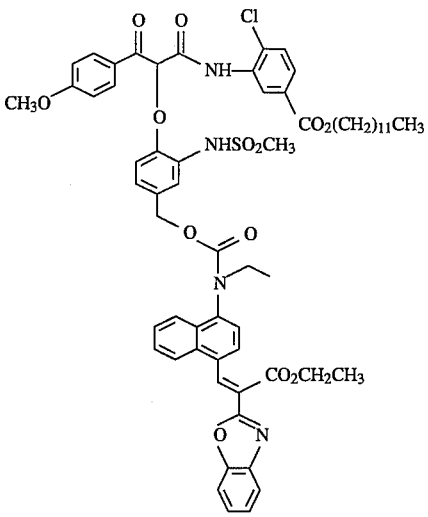
I-39
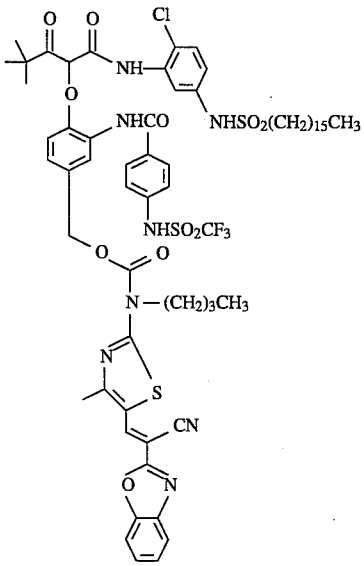
I-40
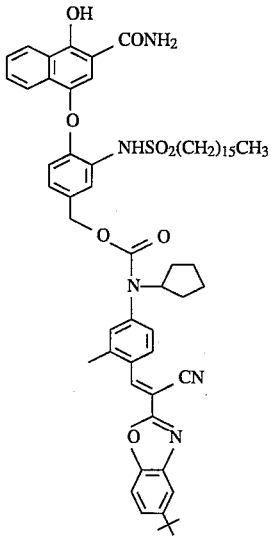

-continued
I-41
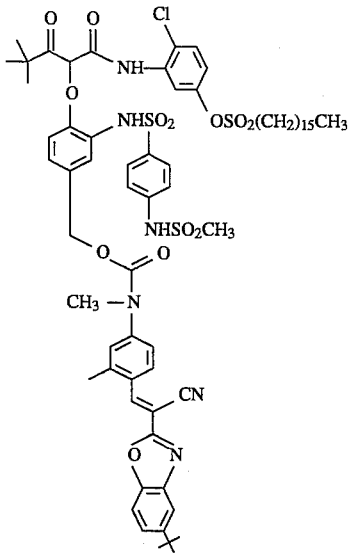
I-42
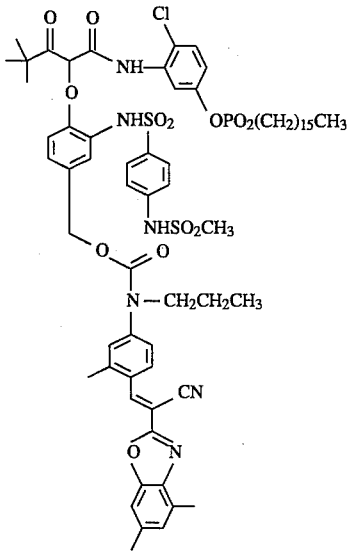
I-43
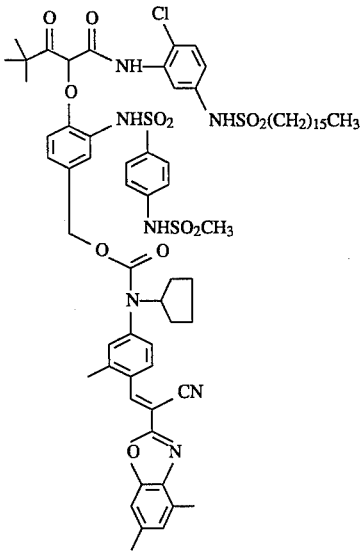
-continued
I-44
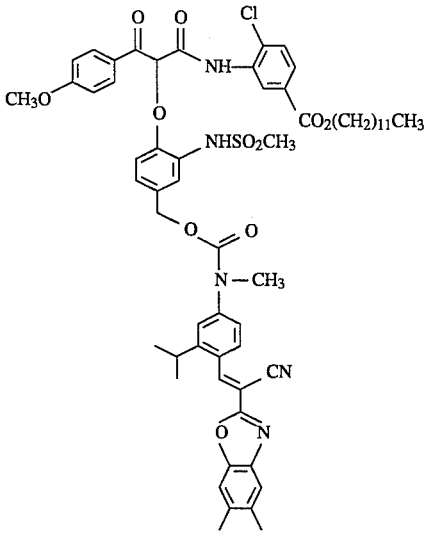
I-45
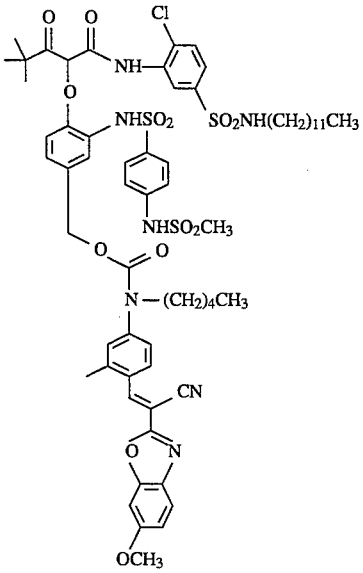
I-46
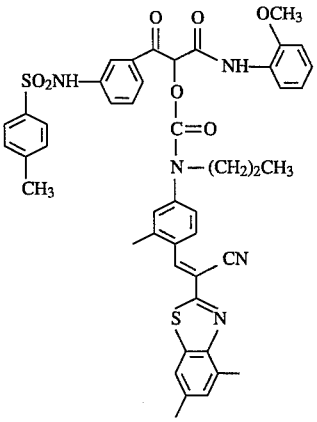

-continued
I-47
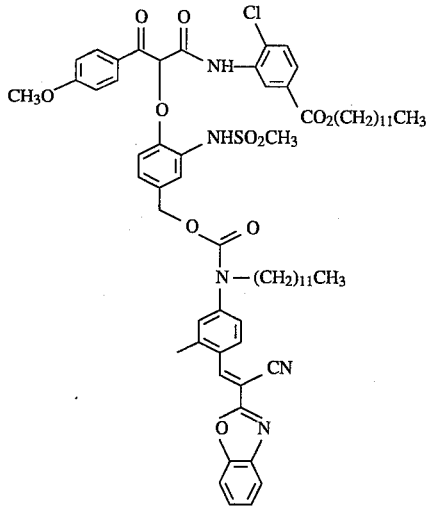
I-48
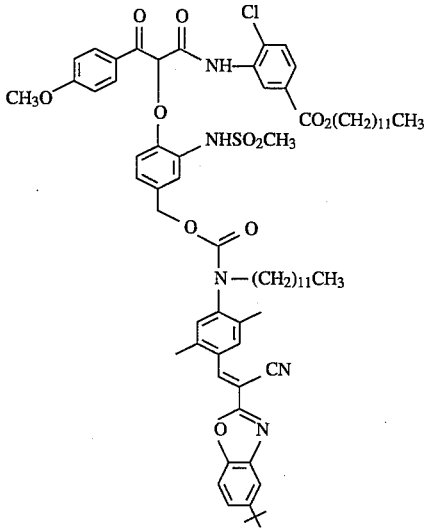
-continued
I-49
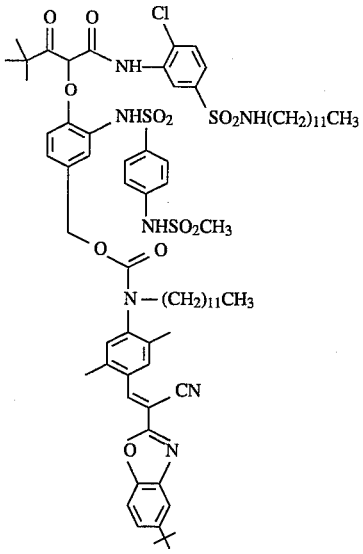
I-50
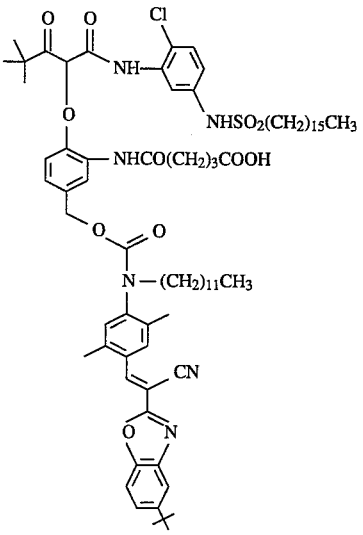

-continued
I-51
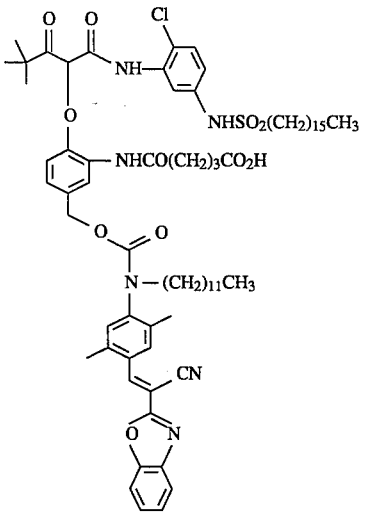
I-52
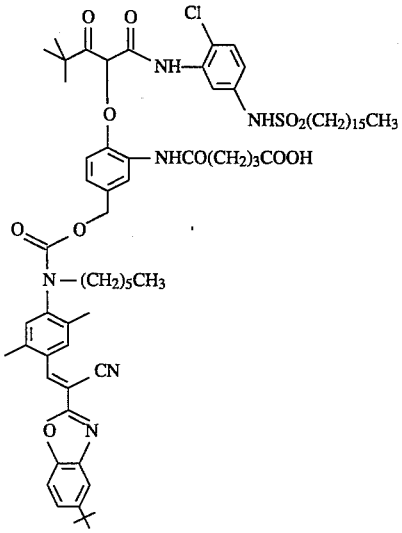
I-53
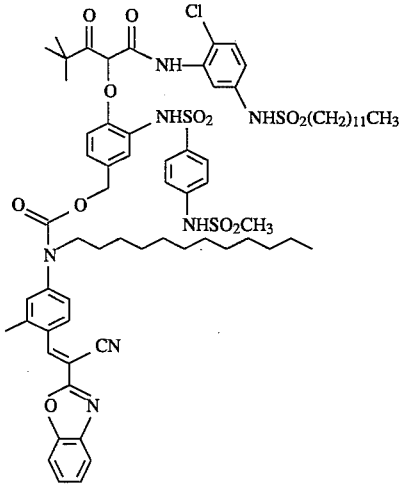
-continued
I-54
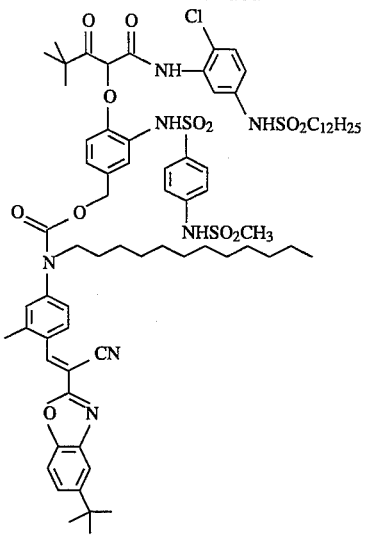
I-55
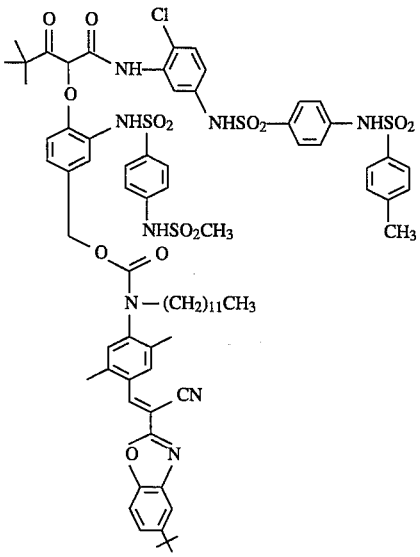
I-56
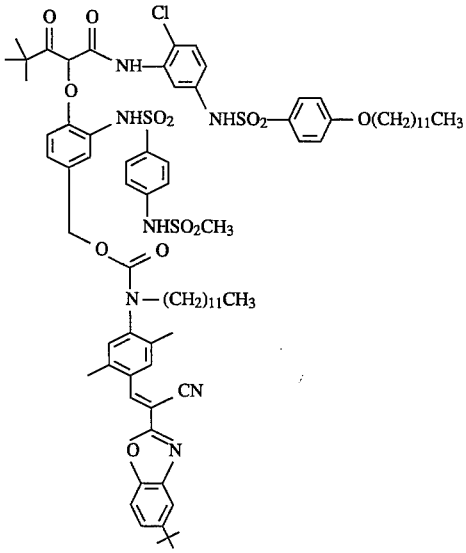

-continued
I-57
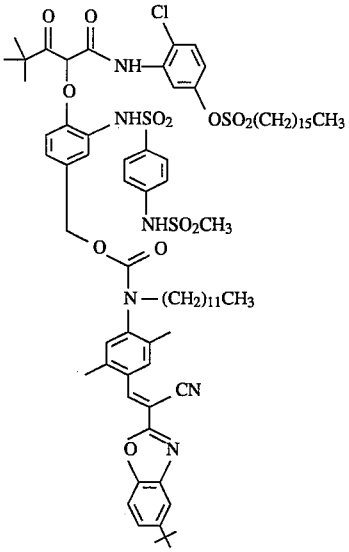
I-58
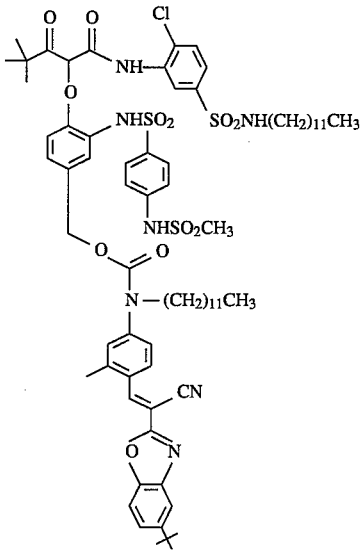
I-59
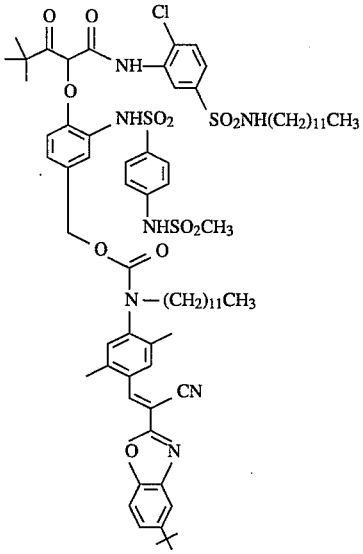
-continued
I-60
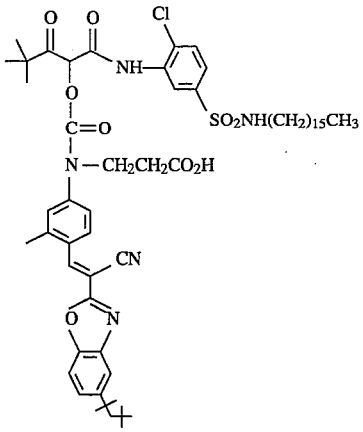
I-61
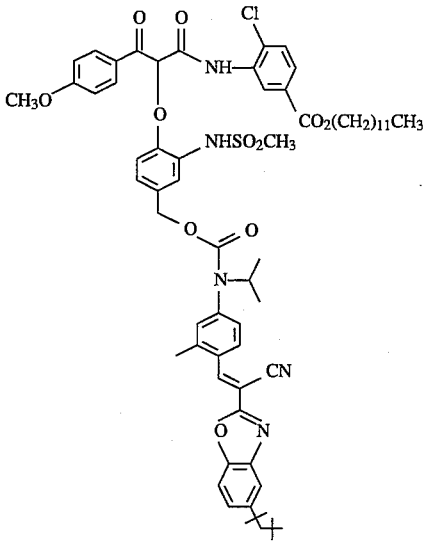
I-62
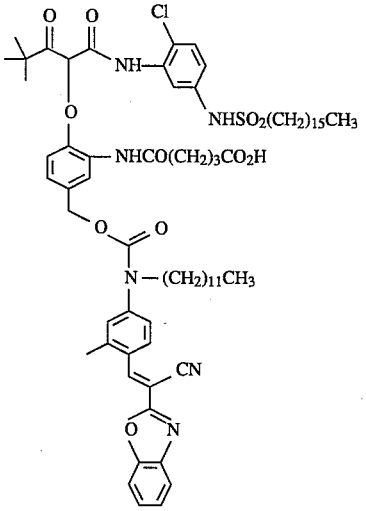

-continued

I-63

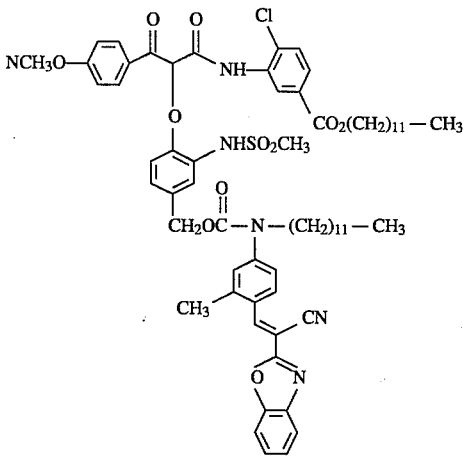

I-64

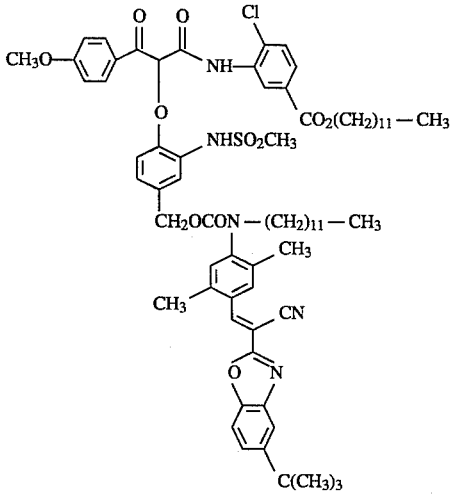

I-65

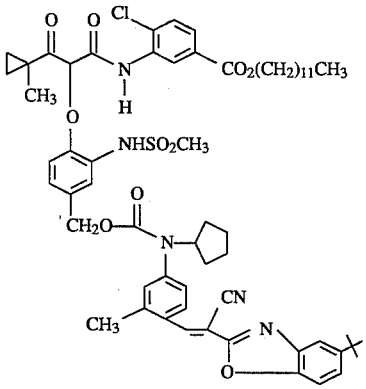

-continued

I-66

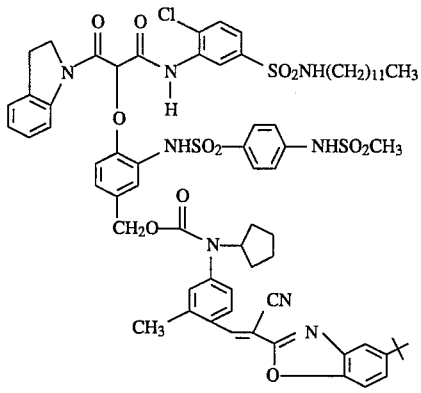

I-67

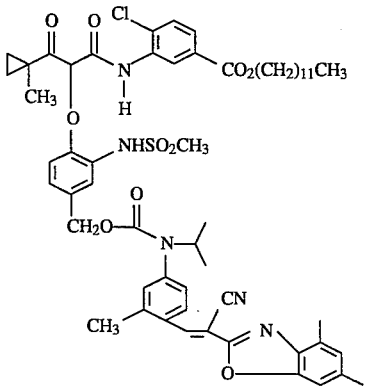

I-68

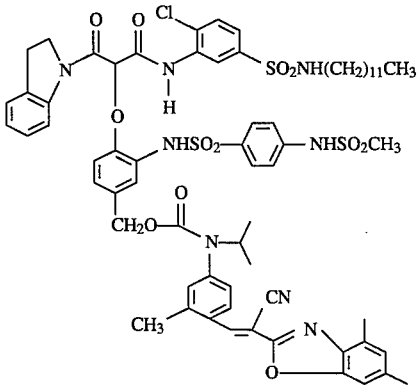

The method of the invention provides for the exposure of a photographic element of the invention followed by contacting the element with a color developing chemical to form a color image. Color forming chemicals are described more fully hereinafter.

The invention disclosed herein can be used in combination with one or more of the inventions disclosed in applications cofiled herewith under attorney Docket Nos. 66037, 66957, 67358, and 69927 which are incorporated herein by reference in their entirety.

As used herein, the term substituent, unless otherwise specifically stated, has a broad definition. The substituent may be, for example, halogen, such as chlorine, bromine or fluorine; nitro; hydroxyl; cyano; and —$CO_2H$ and its salts; and groups which may be further substituted, such as alkyl, including straight or branched chain alkyl, such as methyl, trifluoromethyl, ethyl, t-butyl, 3-(2,4-di-t-amylphenoxy)propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy 2-(2,4-di-t-pentylphenoxy)ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentylphenoxy)acetamido, alpha-(2,4-di-t-pentylphenoxy)butyramido, alpha-(3-pentadecylphenoxy)hexanamido, alpha-(4-hydroxy-3-butylphenoxy)tetradecanaido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl)carbonylamino, p-dodecylphenylcarbonylamino, p-toluylcarbonylamino, N-methylureido, N,N-dimethylureido, N-methyl-N-dodecylureido, N-hexadecylureido, N,N-dioctadecylureido dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy)ethylthio, phenylthio, 2-butoxy-5-t-octylphenylthio, octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; and silyloxy, such as trimethylsilyloxy.

The particular substituents used may be selected to attain the desired photographic properties for a specific application and can include, for example, hydrophobic groups, solubilizing groups, etc. Generally, the above groups and substituents thereof may typically include those having 1 to 42 carbon atoms and usually less than 24 carbon atoms, but greater numbers are possible depending on the particular substituents selected. Moreover, as indicated, the substituents may themselves be suitably substituted with any of the above groups.

The materials of the invention can be used in any of the ways and in any of the combinations known in the art. Typically, the invention materials are combined with a silver halide emulsion and the mixture is coated as a layer on a support to form part of a photographic element. Alternatively, they can be incorporated at a location adjacent to the silver halide emulsion layer where, during development, they will be in reactive association with development products such as oxidized color developing agent. Thus, as used herein, the term "associated" signifies that the compound is in the silver halide emulsion layer or in an adjacent location where, during processing, it is capable of reacting with silver halide development products.

It may be desirable to include a high molecular weight hydrophobe or "ballast" group in the component molecule to control the migration of various components. Representative ballast groups include substituted or unsubstituted alkyl or aryl groups containing 8 to 42 carbon atoms. Representative substituents on such groups include alkyl, aryl, alkoxy, aryloxy, alkylthio, hydroxy, halogen, alkoxycarbonyl, aryloxycarbonyl, carboxy, acyl, acyloxy, amino, anilino, carbonamido, carbamoyl, alkylsulfonyl, arysulfonyl, sulfonamido, and sulfamoyl groups wherein the substituents typically contain 1 to 42 carbon atoms. Such substituents can also be further substituted.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

If desired, the photographic element can be used in conjunction with an applied magnetic layer as described in *Research Disclosure,* November 1992, Item 34390 published by Kenneth Mason Publications, Ltd., Dudley Annex, 12a North Street, Emsworth, Hampshire P010 7DQ, ENGLAND; and in U.S. Pat. Nos. 5,252,441; 5,254,449; and 5,254,446; the contents of which are incorporated herein by reference.

Color negative films employing such layers can be employed, in combination with cameras that can record and cause to be stored on such a layer, various useful information related to the use and history of the film. Specific examples include exposure information on a per scene and per roll basis. These films can then be processed in automated processing apparatus that can retrieve film chatacteristic information as well as film exposure and use information, and optionallly modify the processing to ensure optimal performance and optionally record the details of processing of the magentic layer. The films can then be printed using automated printers that can retrieve both film and process history information and optionally alter, based on the information, exposure characteristics chosen from printing time, printing light intensity, printing light color balance, printing light color temperature, printing magnification or printing lens adjustment, exposure, or printing time, and the color filters so as to enable production of well-balanced display prints from various color originating materials. These layers can be located on the same side of the support as light sensitive layers or arranged so that the support is between the magnetic layer and the light sensitive layers. This information is useful in altering film processing and printing conditions so as to aid in producing a pleasing image.

It is specifically contemplated to employ supports bearing magnetic layers as described.

In the following discussion of suitable materials for use in the emulsions and elements of this invention, reference will be made to *Research Disclosure,* December 1989, Item 308119, available as described above, which will be identified hereafter by the term "Research Disclosure." The contents of the Research Disclosure, including the patents and publications referenced therein, are incorporated herein by reference, and the Sections hereafter referred to are Sections of the Research Disclosure. The materials of the invention may also be used in conjunction with the materials described in *Koukai Gihou NO.* 94-6023, Hatsumei Kyoukai, March 1994, available from the Japanese Patent Office, which is incorporated herein by reference.

The silver halide emulsions employed in the elements of this invention can be either negative-working or positive-working. Suitable emulsions and their preparation as well as methods of chemical and spectral sensitization are described in Sections I through IV. Color materials and development modifiers are described in Sections VII and XXI. Vehicles are described in Section IX, and various additives such as brighteners, antifoggants, stabilizers, light absorbing and scattering materials, hardeners, coating aids, plasticizers, lubricants and matting agents are described, for example, in Sections V, VI, VIII, X, XI, XII, and XVI. Manufacturing methods are described in Sections XIV and XV, other layers and supports in Sections XIII and XVII, processing methods and agents in Sections XIX and XX, and exposure alternatives in Section XVIII.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in U.K. Patents and published application Nos. 1,466,728, 1,531,927, 1,533,039, 2,006,755A and 2,017,704A, the disclosures of which are incorporated herein by reference.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. Nos. 2,983,608; 4,070,191; and 4,273,861; German Applications DE 2,706,117 and DE 2,643,965; U.K. Patent 1,530,272; and Japanese Application A-113935. The masking couplers may be shifted or blocked, if desired.

For example, in a color negative element, the materials of the invention may replace or supplement the materials of an element comprising a support bearing the following layers from top to bottom:

(1) one or more overcoat layers containing ultraviolet absorber(s);

(2) a two-coat yellow pack with a fast yellow layer containing "Coupler 1": Benzoic acid, 4-chloro-3-((2-(4-ethoxy-2,5-dioxo-3 -(phenylmethyl)-1-imidazolidinyl)-3-(4-methoxyphenyl)-1,3-dioxopropyl)amino)-, dodecyl ester and a slow yellow layer containing the same compound together with "Coupler 2": Propanoic acid, 2-[[5-[[4-[2-[[[2,4 -bis(1,1-dimethylpropyl)phenoxy]acetyl]amino]-5-[(2,2,3,3,4,4,4 -heptafluoro-1-oxobutyl)amino]-4-hydroxyphenoxy]-2,3-dihydroxy-6-[(propylamino)carbonylphenyl] thio]-1,3,4-thiadiazol-2-yl]thio]-, methyl ester and "Coupler 3": 1-((dodecyloxy)carbonyl)ethyl(3-chloro-4-((3-(2 -chloro-4-((1-tridecanoyl)-carbonyl)anilino)-3-oxo-2-((4)(5)(6)-(phenoxycarbonyl)-1H-benzotriazol-1-yl-)propanoyl)amino))benzoate;

(3) an interlayer containing fine metallic silver;

(4) a triple-coat magenta pack with a fast magenta layer containing "Coupler 4": Benzamide, 3-((2-(2,4-bis(1,1-dimethylpropyl)phenoxy)-1-oxobutyl)amino)-N-(4,5-dihydro-5-oxo-1-(2,4,6 -trichlorophenyl)-1H-pyrazol-3-yl)-, "Coupler 5": Benzamide, 3-((2-(2,4-bis(1,1-dimethylpropyl)phenoxy)-1-oxobutyl)amino)-N-(4',5'-dihydro-5'-oxo-1'-(2,4,6-trichlorophenyl)(1,4'-bi-1H-pyrazol)-3'-yl)-, "Coupler 6": Carbamic acid, (6-(((3-(dodecyloxy)propyl)amino)carbonyl)-5-hydroxy-1-naphthalenyl)-, 2-methylpropyl ester , "Coupler 7": Acetic acid, ((2-((3-(((3-(dodecyloxy)propyl)amino)carbonyl)-4-hydroxy-8-(((2 -methylpropoxy)carbonyl)amino)-1-naphthalenyl)oxy )ethyl)thio)-, and "Coupler 8" Benzamide, 3-((2-(2,4-bis(1,1-dimethylpropyl)phenoxy)-1-oxobutyl)amino)-N-(4,5-dihydro-4-((4-methoxyphenyl)azo)-5-oxo-1-(2,4,6-trichlorophenyl)-1 H-pyrazol-3-yl)-; a mid-magenta layer and a slow magenta layer each containing "Coupler 9": a ternary copolymer containing by weight in the ratio 1:1:2 2-Propenoic acid butyl ester, styrene, and N-[1-(2,4,6-trichlorophenyl)-4,5-dihydro-5-oxo- 1H-pyrazol-3-yl]-2-methyl-2-propenamide; and "Coupler 10": Tetradecanamide, N-(4-chloro-3-((4-((4-((2,2-dimethyl-1-oxopropyl)amino)phenyl)azo)-4,5-dihydro-5-oxo-1-(2,4,6-trichlorophenyl)-1H-pyrazol-3-yl)amino)phenyl)-, in addition to Couplers 3 and 8;

(5) an interlayer;

(6) a triple-coat cyan pack with a fast cyan layer containing Couplers 6 and 7; a mid-cyan containing Coupler 6 and "Coupler 11": 2,7-Naphthalenedisulfonic acid, 5-(acetylamino)-3-((4-(2-((3-(2,4-bis(1,1 -dimethylpropyl)phenoxy)propylamino)carbonyl)-4-hydroxy-1-naphthalenyl)oxy)ethoxy)phenyl)azo)-4-hydroxy-, disodium salt; and a slow cyan layer containing Couplers 2 and 6;

(7) an undercoat layer containing Coupler 8; and (8) an antihalation layer.

In a color paper format, the materials of the invention may replace or supplement the materials of an element comprising a support bearing the following layers from top to bottom:

(1) one or more overcoats;

(2) a cyan layer containing "Coupler 1": Butanamide, 2-(2,4-bis(1,1-dimethylpropyl)phenoxy)-N-(3,5-dichloro-2-hydroxy-4-methylphenyl)-, "Coupler 2": Acetamide, 2-(2,4-bis(1,1-dimethylpropyl)phenoxy)-N-(3,5-dichloro-2-hydroxy-4-, and UV Stabilizers: Phenol, 2-(5-chloro-2H-benzotriazol-2-yl)-4,6-bis(1,1-dimethylethyl)-;Phenol, 2-(2H-benzotriazol-2-yl)-4-(1,1-dimethylethyl)-;Phenol, 2-(2H-benzotriazol-2-yl)-4-(1,1-dimethylethyl)-6-(1-methylpropyl)-; and Phenol, 2-(2H-benzotriazol-2-yl)-4,6-bis(1,1-dimethylpropyl)- and a poly(t-butylacrylamide) dye stabilizer;

(3) an interlayer;

(4) a magenta layer containing "Coupler 3": Octanamide, 2-[2,4-bis(1,1-dimethylpropyl)phenoxy]-N-[2-(7-chloro-6-methyl-1H-pyrazolo[1,5-b][1,2,4]triazol-2-yl)propyl]- together with 1,1'-Spirobi(1H-indene), 2,2',3,3'-tetrahydro-3,3,3',3'-tetramethyl-5,5',6,6'-tetrapropoxy-;

(5) an interlayer; and (6) a yellow layer containing "Coupler 4": 1-Imidazolidineacetamide, N-(5-((2-(2,4-bis(1,1-dimethylpropyl)phenoxy)-1-oxobutyl)amino)-2 -chlorophenyl)-.alpha.-(2,2-dimethyl-1-oxopropyl)-4-ethoxy-2,5-dioxo-3-(phenylmethyl)-.

In a reversal format, the materials of the invention may replace or supplement the materials of an element comprising a support bearing the following layers from top to bottom:

(1) one or more overcoat layers;

(2) a nonsensitized silver halide containinglayer;

(3) a triple-coat yellow layer pack with a fast yellow layer containing "Coupler 1": Benzoic acid, 4-(1-(((2-chloro-5-((dodecylsulfonyl)amino)phenyl)amino)carbonyl)-3,3-dimethyl-2-oxobutoxy)-, 1-methylethyl ester; a mid yellow layer containing Coupler 1 and "Coupler 2": Benzoic acid, 4-chloro-3-[[2-[4-ethoxy-2,5-dioxo-3-(phenylmethyl)-1-imidazolidinyl]-4,4-dimethyl-1,3-dioxopentyl]amino]-, dodecylester; and a slow yellow layer also containing Coupler 2;

(4) an interlayer;

(5) a layer of fine-grained silver;

(6) an interlayer;

(7) a triple-coated magenta pack with a fast and mid magenta layer containing "Coupler 3": 2-Propenoic acid, butyl ester, polymer with N-[1-(2,5-dichlorophenyl)-4,5-dihydro-5-oxo-1H-pyrazol-3-yl]-2 -methyl-2-propenamide; "Coupler 4": Benzamide, 3-((2-(2,4-bis(1,1-dimethylpropyl)phenoxy)-1 -oxobutyl)amino)-N-(4,5-dihydro-5-oxo-1-(2,4,6-trichlorophenyl)-1 H-pyrazol-3-yl)-; and "Coupler 5": Benzamide, 3-(((2,4-bis(1,1-dimethylpropyl)phenoxy)acetyl)amino)-N-(4,5-dihydro-5-oxo-1-(2,4,6-trichlorophenyl)-1H-pyrazol-3-yl)-; and containing the stabilizer 1,1'-Spirobi(1H-indene), 2,2',3,3'-tetrahydro-3,3,3',3'-tetramethyl-5,5',6,6'-tetrapropoxy-; and in the slow magenta layer Couplers 4 and 5 with the same stabilizer;

(8) one or more interlayers possibly including fine-grained nonsensitized silver halide;

(9) a triple-coated cyan pack with a fast cyan layer containing "Coupler 6": Tetradecanamide, 2-(2 -cyanophenoxy)-N-(4-((2,2,3,3,4,4,4-heptafluoro-1-oxobutyl)amino)-3-hydroxyphenyl)-; a mid cyan containing "Coupler 7": Butanamide, N-(4-((2-(2,4-bis(1,1-dimethylpropyl)phenoxy)-1-oxobutyl)amino)-2-hydroxyphenyl)-2,2,3,3,4,4,4-heptafluoro- and "Coupler 8": Hexanamide, 2-(2,4-bis(1,1-dimethylpropyl)phenoxy)-N-( 4-((2,2,3,3,4,4,4-heptafluoro-1-oxobutyl)amino)-3-hydroxyphenyl)-; and a slow cyan layer containing Couplers 6, 7, and 8;

(10) one or more interlayers possibly including fine-grained nonsensitized silver halide; and

(11) an antihalation layer.

The inventive materials may be used in association with materials that accelerate or otherwise modify the processing steps e.g. of bleaching or fixing to improve the quality of the image. Bleach accelerator releasing couplers such as those described in EP 193,389; EP 301,477; U.S. Pat. Nos. 4,163,669; 4,865,956; and 4,923,784, may be useful. Also contemplated is use of the compositions in association with nucleating agents, development accelerators or their precursors (UK Patent 2,097,140; U.K. Patent 2,131,188); electron transfer agents (U.S. Pat. Nos. 4,859,578; 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. Nos. 4,420,556; and 4,543,323.) Also, the compositions may be blocked or coated in protected form as described, for example, in Japanese Application 61/258,249 or U.S. Pat. No. 5,019,492.

The invention materials may further be used in combination with image-modifying compounds such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, tellurotetrazoles or benzisodiazoles. In a preferred embodiment, the inhibitor moiety or group is selected from the following formulas:

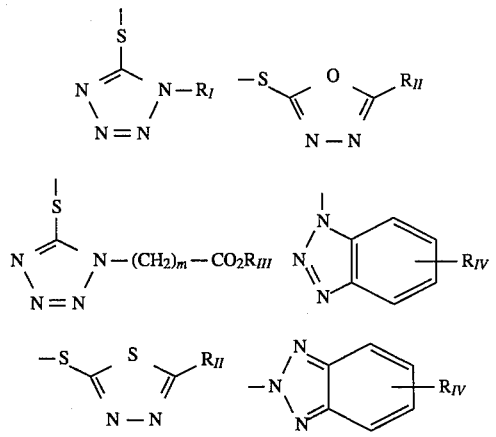

wherein $R_I$ is selected from the group consisting of straight and branched alkyls of from 1 to about 8 carbon atoms, benzyl, phenyl, and alkoxy groups and such groups containing none, one or more than one such substituent; Rii is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

As mentioned, the developer inhibitor-releasing coupler may include a timing group, which groups have been described earlier with respect to the high dye-yield coupler of the invention. Suitable developer inhibitor-releasing couplers for use in the present invention include, but are not limited to, the following:

D1

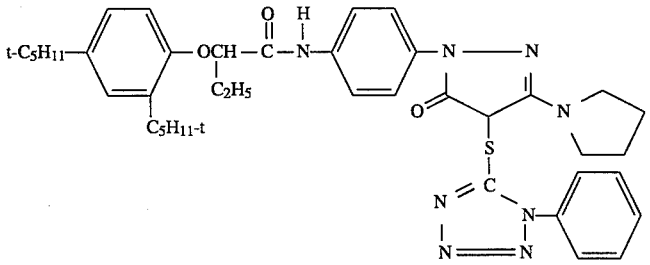

-continued
D2
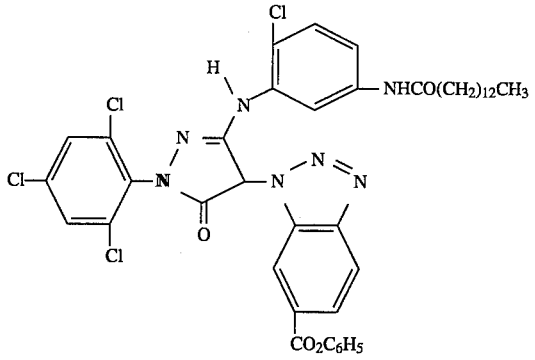
D3
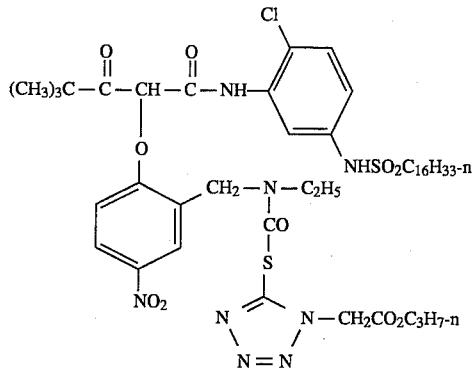
D4
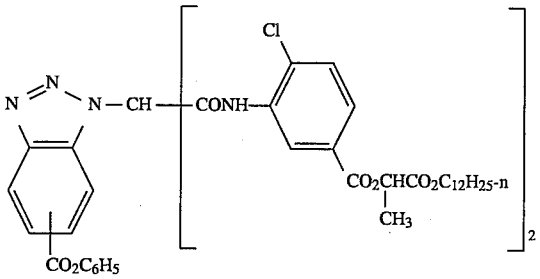
D5
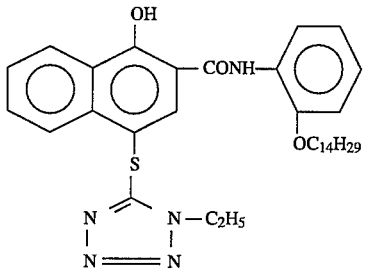
D6
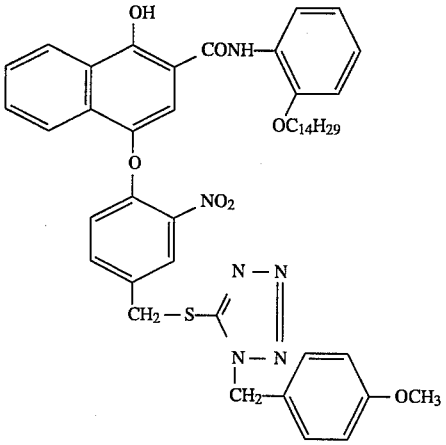
D7
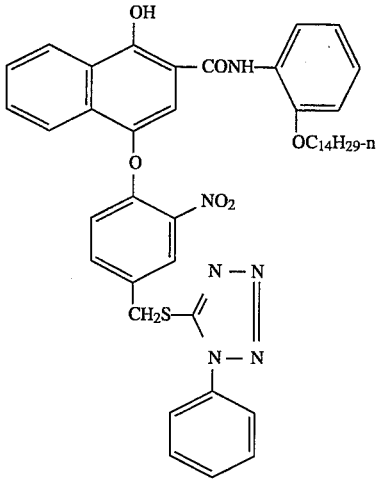
D8
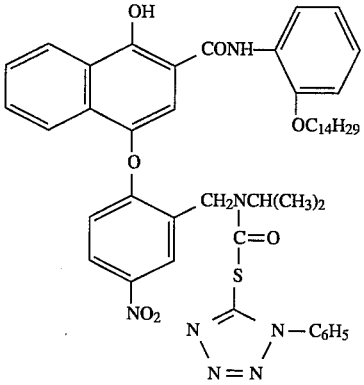
D9
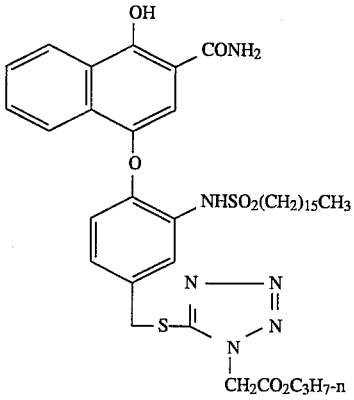

-continued

D10

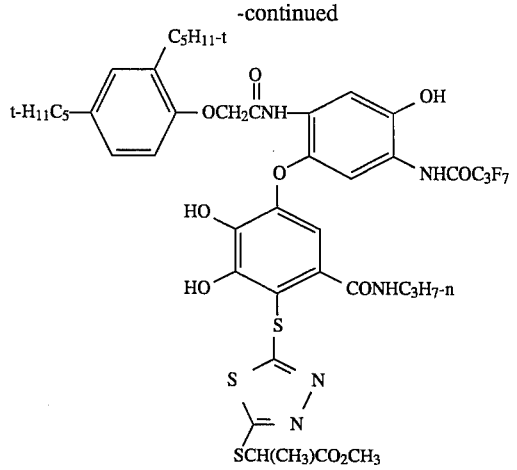

It is also contemplated that the concepts of the present invention may be employed to obtain reflection color prints as described in *Research Disclosure,* November 1979, Item 18716, available from Kenneth Mason Publications, Ltd, Dudley Annex, 12a North Street, Emsworth, Hampshire P0101 7DQ, England, incorporated herein by reference. Materials of the invention may be coated on pH adjusted support as described in U.S. Pat. No. 4,917,994; on a support with reduced oxygen permeability (EP 553,339); with epoxy solvents (EP 164,961); with nickel complex stabilizers (U.S. Pat. Nos. 4,346,165; 4,540,653 and 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630; 90-072,631; 90-072,632; 90-072,633; 90-072,634; 90-077,822; 90-078,229; 90-078,230; 90-079,336; 90-079,337; 90-079,338; 90-079,690; 90-079,691; 90-080,487; 90-080,488; 90-080,489; 90-080,490; 90-080,491; 90-080,492; 90-080,494; 90-085,928; 90-086,669; 90-086,670; 90-087,360; 90-087,361; 90-087,362; 90-087,363; 90-087,364; 90-088,097; 90-093,662; 90-093,663; 90-093,664; 90-093,665; 90-093,666; 90-093,668; 90-094,055; 90-094,056; 90-103,409; 83-62,586; 83-09,959.

Especially useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in micrometers and t is the average thickness in micrometers of the tabular grains.

The average useful ECD of photographic emulsions can range up to about 10 micrometers, although in practice emulsion ECD's seldom exceed about 4 micrometers. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin (t<0.2 micrometer) tabular grains. To achieve the lowest levels of granularity it is preferred that aim tabular grain projected areas be satisfied with ultrathin (t<0.06 micrometer) tabular grains. Tabular grain thicknesses typically range down to about 0.02 micrometer. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micrometer. Ultrathin tabular grain high chloride emulsions are disclosed by Maskasky U.S. Pat No. 5,217,858.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: Research Disclosure, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

Silver chloride tabular grains useful in this invention include those having {100} major faces. These grains are both morphologically stable and capable of being readily sensitized with a variety of sensitizing dyes. Silver chloride emulsions characterized by at least 50 percent of the grain population projected area being accounted for by tabular grains (1) bounded by {100} major faces having adjacent edge ratios of less than 10 and (2) each having an aspect ratio of at least 2, as described by House et al in allowed U.S. application Ser. No. 112,489 and by Maskasky in U.S. Pat. No. 5,264,337 and allowed U.S. Ser. No. 035,349 the disclosures of which are incorporated herein by reference, are suitable for the invention.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. The described elements can be processed in the known C-41 color process as described in The British Journal of Photography Annual of 1988, pages 191–198. Where applicable, the element may be processed in accordance with color print processes such a the RA-4 process of Eastman Kodak Company as described in the British Journal of Photography Annual of 1988, Pp 198–199. To provide a positive (or reversal) image, the color development step can be preceded by development with a non-chromogenic developing agent to develop exposed silver halide, but not form dye, and followed by uniformly fogging the element to render unexposed silver halide developable. Alternatively, a direct positive emulsion can be employed to obtain a positive image.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(β-(methanesulfonamido)ethyl)aniline sesquisulfate hydrate, 4-amino-3-methyl-N-ethyl-N-(β-hydroxyethyl)aniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleachfixing, to remove silver or silver halide, washing, and drying.

It is understood thoroughout this specification and claims that any reference to a substituent by the identification of a group containing a substitutable hydrogen (e.g. alkyl, amine, aryl, alkoxy, heterocyclic, etc.), unless otherwise specifically stated, shall encompass not only the substituent's unsubstituted form, but also its form further substituted with any photographically useful substituents. Usually the further substituent will have less than 30 carbon atoms and typically less than 20 carbon atoms.

The couplers of the invention can be prepared by methods known in the organic synthesis art including those methods described in U.S. Pat. No. 4,840,884.

Coupler Synthesis

Preparation of Inventive Coupler Having the Formula:

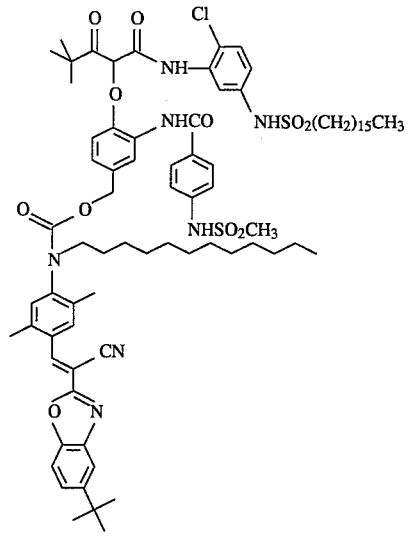

The overall scheme for the synthesis of the coupler is illustrated in Scheme I. The linking group intermediate 10 was prepared in four steps. Commercially available methyl-p-amino benzoate (78.6 g, 0.52 mole) was dissolved in about 500 mL of methylene chloride containing 2,6-lutidine (56 g, 0.52 mole, 60.7 mL), cooled in an ice bath, and treated with trifluoromethane sulfonic anhydride (146 g, 0.52 mole/l in 50 mL of methylene chloride) dropwise over 5 min. The reaction mixture was warmed to room temperature over 30 min before washing with excess 2N HCl. The organic phase was then washed four times with 250 mL portions of 1N $NaHCO_3$. The aqueous washes were acidified with 12N HCl to precipitate a creamy solid which was collected, washed with water, and air dried to yield 86 g of the trifluoromethylsulfonamide (methyl-p-trifluoromethyl-sulfonamido benzoate). This trifluoromethylsulfonamide (86 g, 0.3 mole) was added to a stirred solution of NaOH (55 g, 1.38 mole) in 660 mL of water. The mixture was stirred for about 15 min before acidifying with excess 2N HCl to yield a precipitate that was collected, washed with water, and air dried to yield 72 g of the saponified benzoic acid. This benzoic acid (74.9 g, 0.278 mole) was converted to acid chloride by stirring in a mixture of 350 mL ethyl acetate, 3 drops of DMF, and 53 g (0.417 mole) oxalyl chloride for 3 hr. Solvents were distilled off under vacuum and residual oxalyl chloride was chased three times with a mixture of 150 mL methylene chloride and 50 mL heptane. The crude oil was mixed with 25 mL of heptane and placed in a refrigerator overnight. The crystals that formed were slurried in about 200 mL of heptane and air dried to yield 57.6 g of the acid chloride. This acid chloride (57.6 g, 0.198 mole, in 100 mL tetrahydrofuran) was added dropwise over 10 min with good stirring to a solution of 3-amino-4-hydroxy benzyl alcohol (27.5 g, 0.198 mole) in 100 mL of pyridine cooled to 5° C. in a 3-neck round-bottomed flask fitted with mechanical stirrer. After 30 min at room temperature, the reaction mixture was diluted with 300 mL of ethyl acetate and washed with excess 2N HCl and water. The organic layer was dried over $MgSO_4$ and stripped to a crude oil that crystallized rapidly with addition of 200 ml heptane. The crystals were collected and air dried to yield 69 g of the linking group 10. This linking group 10 was attached to coupler 11 by combining 32 g (0.082 mole) of 10 and 48.5 g (0.082 mole) of 11 with 200 mL of DMF and treating with tetramethylguanidine (18.8 g, 0.164 mole). The reaction mixture was stirred for 2 hr and then diluted with ethyl acetate and washed with excess 1N HCl and water. The organic layer was dried over $MgSO_4$ and concentrated to an oil. The oil was dissolved in 2 parts of ethyl acetate and diluted with 8 parts heptane. The solvents were evaporated with stirring to yield brown crystals. These crystals were slurried in heptane, collected, and air dried to yield about 60 g of the target coupler.

The dye intermediate 13 was prepared according to Scheme II, illustrated below. Commercially available 2,5-dimethylaniline (50 g, 0,413 mole) was added to formic acid (46 g, 1 mole, 38 mL) in a round-bottomed flask fitted with a condenser and heating mantle. The mixture was heated to reflux for 2 hr and then cooled to room temperature before pouring into 2 L of cold water with good stirring. The resulting precipitate was collected and air dried to yield 61 g of the formamide (2,5-dimethylformanilide). This formamide (59.6 g, 0.4 mole) and bromodecane (104.6 g, 0.4 mole) were mixed with 40 mL t-butanol and 400 mL THF in a 3-neck round-bottomed flask fitted with a reflux condenser, heating mantle, and nitrogen purge. The mixture was treated with potassium t-butoxide (49.2 g), heated to reflux for 12 hr, cooled to room temperature, and diluted with ethyl acetate. The mixture was then washed with excess 1N HCl and water. The organic layer was dried over $MgSO_4$ and concentrated to yield about 120 g of crude alkylated formamide. Alkylated formamide (120 g, 0.38 mole) was dissolved in 420 mL acetic acid and 120 mL 12N HCl and heated to reflux for 16 hr. The solvents were distilled off under vacuum, and the resulting solid was collected and air dried to yield 107 g of the corresponding amine hydrochloride (2,5-dimethyl-N-dodecyl aniline hydrochloride). This amine hydrochloride (34.2 g, 0.105 mole) was mixed with 250 mL acetic acid, 20 mL 12N HCl, and 20 mL formaldehyde in a large mouth 3-L round-bottomed flask fitted with a mechanical stirrer and a heating mantle. The mixture was heated to about 80° C. before removing the heat and treating with N,N-dimethylnitrosoaniline (22.5 g, 0.15 mole) in portions over a 10-min interval with good stirring. The solvents were distilled off under vacuum and the resulting oil was dissolved in 300 mL of ethyl acetate and excess 2N HCl. The aqueous phase was washed an additional three times with 300 mL portions of ethyl acetate. These ethyl acetate extracts were passed through a pad of silica gel before removing solvent under vacuum to yield a slurry that crystallized with the addition of 500 mL of heptane. The crystals were collected and air dried to yield 17 g of the aldehyde (2,5-dimethyl-4-dodecylamino-benzaldehyde; DMBA).

Commercially available 4-t-butyl phenol (30 g, 0.2 mole) was dissolved in 200 mL ethyl acetate in a 600-mL round-bottomed flask fitted with a mechanical stirrer, and cooled to 0° C. The mixture was treated with nitric acid (13 mL, in 13 mL water) dropwise over 10 min and then a catalytic amount of $NaNO_2$. After 45 min the reaction was washed with excess 1N HCl and the organic layer was dried over $MgSO_4$ and stripped to yield 37 g of 2-nitro-4-t-butyl phenol. This nitrophenol (37 g, 0.19 mole) was dissolved in 100 mL ethyl acetate and placed into a Parr bottle with a teaspoon of 10% Pd/C. The mixture was placed on a hydrogenator under 50 psi hydrogen with agitation for 1 hr. The catalyst was filtered off through celite, and the ethyl acetate was stripped off under vacuum. The material crystallized with the addition of about 200 mL heptane to give 25.6 g of the corresponding amine (2-amino-4-t-butyl phenol).

Malononitrile (39.6 g, 0.6 mole) was dissolved in methanol (38 g, 1.2 mole, 48 mL) and 200 mL of methyl formate in a 1-L, 3-neck round-bottomed flask with an ice bath and addition funnel. The mixture was cooled to 10° C. and treated dropwise over 5 min with thionyl chloride (55 g, 0.46 mole, 33.6 mL). A precipitate formed after 30 min and an additional 100 mL of methyl formate was added. After 1 hr the precipitate was collected and air dried for 20 min to yield 52 g of the corresponding imine salt intermediate 14. This salt was stored in an air-tight bottle purged with nitrogen. This imine salt (10.7 g, 0.08 mole) and 2-amino-4-t-butyl phenol (6.6 g, 0.04 mole) were heated with 100 mL methanol at 60° C. for 10 min before diluting with 200 mL of ethyl acetate and excess water. The organic layer was dried over $MgSO_4$ and stripped to yield 8.6 g of the benzoxazole 15. This oil (4.5 g, 0.02 mole) and aldehyde DMBA (6.7 g, 0.02 mole) in 80 mL acetic acid and 3 drops of triethylamine were heated to 80° C. for 15 min and then stirred overnight at room temperature to give a slurry of crystals. The crystals were collected and washed with 100 mL methanol to give two crops yielding about 7 g of the methine dye 16. This dye (3.5 g, 0.0068 mole) was dissolved in about 25 mL methylene chloride and 2,6-lutidine (1.9 g, 0.017 mole). The mixture was treated with phosgene (1.93M in toluene, 0.014 mole, 7.2 mL) over a 1 min interval. After 10 min the mixture was washed in a separatory funnel with excess cold 1N HCl, and then with cold water. The organic phase was dried over $MgSO_4$ and stripped to yield 3.7 g of the carbamoyl chloride 13. After scale-up, this carbamoyl chloride (17.9 g, 0.031 mole) was reacted with coupler 12 (29.3 g, 0.131 mole) in a 1-L, 3-neck round-bottomed flask fitted with nitrogen purge and containing dimethylamino pyridine (3.8 g, 0.031 mole) and 150 mL methylene chloride. The mixture was treated with DBU (1,8-diazabicyclo[5,4,0]undec-7-ene) (14.1 g, 0.093 mole), stirred for 4 hr, diluted with ethyl acetate, and washed with excess 1N HCl and water. The organic layer was dried over $MgSO_4$ and concentrated to a crude oil that was chromatographed on silica gel using methylene chloride/heptane/ethyl acetate (5/3/2) as the eluent. About 20.5 g of the inventive coupler was obtained as a foam.

Scheme I

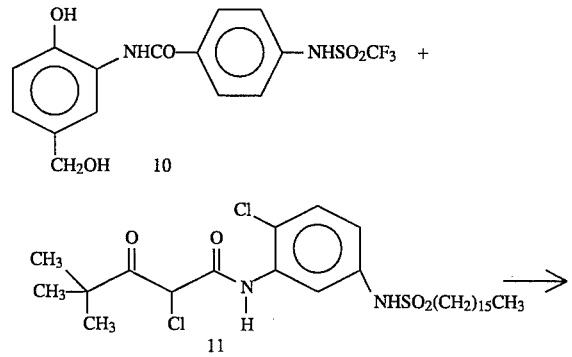

-continued

Scheme I

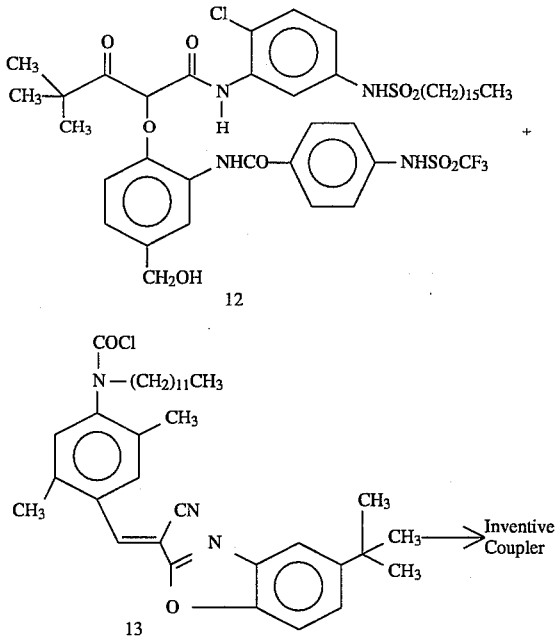

Scheme II

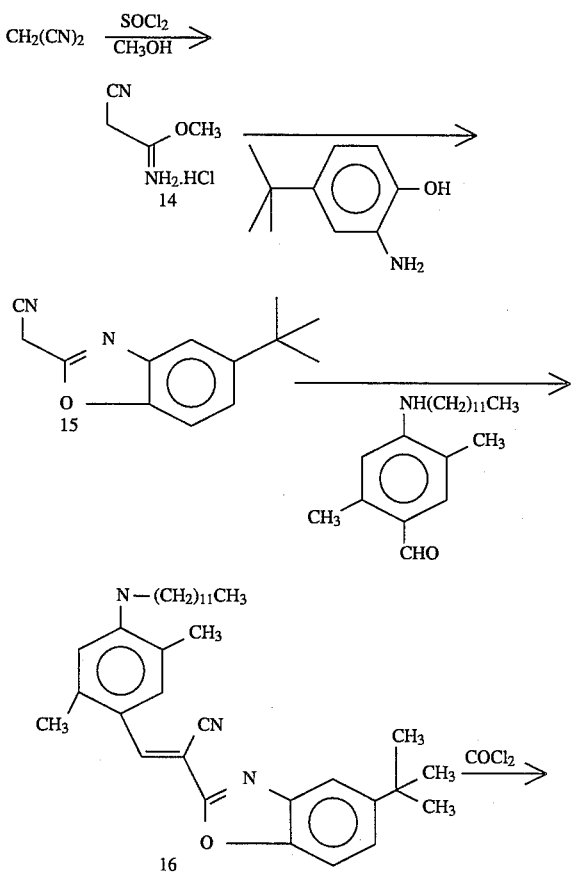

-continued

Scheme II

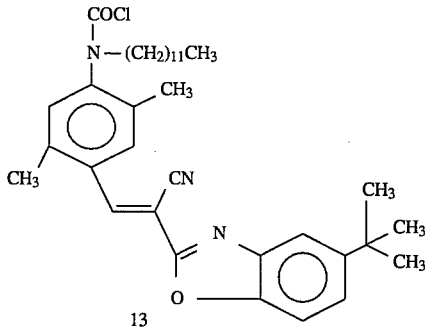

PHOTOGRAPHIC EXAMPLES

| Coating Format 1 | |
|---|---|
| Layer 2 | Gelatin 1.08 g/m$^2$ |
| | Hardener 1,1' - [oxy bis (methylenesulfonyl)]bis-ethene 2% of total gelatin |
| | Spreading agent, Saponin 1% of total volume |
| Layer 1 | Gelatin 2.31 g/m$^2$ |
| | Emulsion 2.15 g/m$^2$ Ag. 2.5 micron mean size, 9 mole % iodide silver iodobromide emulsion |
| | + Image Coupler COMP-Y1 at 0.40 mM/m$^2$. Other COMP and INV at 0.20 mM/m$^2$ |
| | Spreading agent, Saponin 1% of total volume |
| | Remjet film base |

Strips were exposed using a conventional stepwedge and processed using the Kodak Flexicolor C41 process. Couplers were dispersed in di-n-butyl phthalate.

EXAMPLE 1A

This example uses Coating Format 1 and shows the adverse effects that electron withdrawing substituents in the benzoxazole ring of the dye moiety have. The formulas for the couplers employed were as follows:

C-1

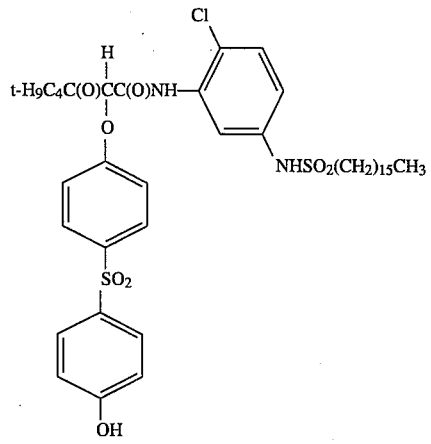

-continued

High Dye-Yield Couplers:

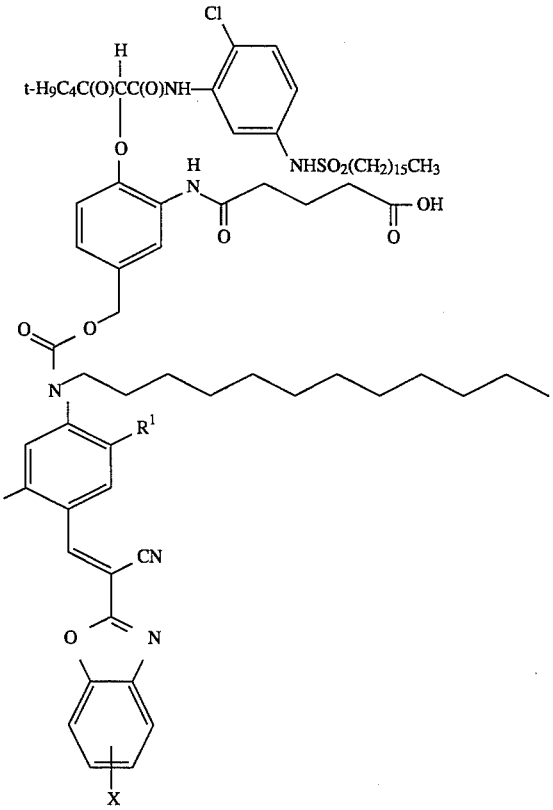

| | | |
|---|---|---|
| CHDY-1 | $R^1 = CH_3$ | X = 4-Cl |
| CHDY-2 | $R^1 = CH_3$ | X = 5-$NHSO_2CH_3$ |
| CHDY-3 | $R^1 = H$ | X = 4-Cl |
| I-51 | $R^1 = CH_3$ | X = H |
| I-52 | $R^1 = CH_3$ | X = 4-t-$C_4H_9$ |
| I-62 | $R^1 = H$ | X = H |

Table I compares the maximum density formed in coatings containing the inventive and comparison compounds to the density formed by commercially used comparative yellow coupler C-1, which was coated at twice the molar level of the other couplers. The percent absorption of the dye image at 550 nm relative to the maximum absorption of the dye image (that is at approximately 450 nm) is given. This figure is a measure of the amount of decomposition of the released dye during processing. The larger the number, the worse the problem. The 550 nm absorbance in the examples given here is due largely to the formation of magenta colored decomposition products. examples given here is due largely to the formation of magenta colored decomposition products.

TABLE I

| COUPLER | % CHANGE IN Dmax vs C-1 | % ABSORPTION AT 550 nm VS MAX ABS (DYE DECOMPOSITION) | HALF LIFE IN FILM Example 1B -min. |
|---|---|---|---|
| I-51 | +1.5 | 7 | 6.7 |
| I-50 | +23.9 | 4 | 22.0 |
| CHDY-1 | +1.5 | 16 | 4.9 |
| CHDY-2 | +7.5 | 11 | N.A. |
| 1-62 | +26.1 | 2 | 11.8 |

TABLE I-continued

| COUPLER | % CHANGE IN Dmax vs C-1 | % ABSORPTION AT 550 nm VS MAX ABS (DYE DECOMPOSITION) | HALF LIFE IN FILM Example 1B -min. |
|---|---|---|---|
| CHDY-3 | +35.8 | 9 | N.A. |

Table I shows that, although all of the high dye-yield couplers give improved Dmax compared to the conventional coupler C-1, the relative absorption at 550 nm is undesirably higher when strong electron withdrawing groups are included as substituents in the benzoxazole aromatic ring. This undesired increase in relative absorption at 550 m indicates problems with decomposition of the coupled-off fragment.

Two other 4-chlorobenzoxazole containing high dye-yield couplers were prepared. These showed 20% and 22% relative absorption at 550 nm. They were not included in the table because their non-chloro-analogs were not prepared for direct comparison, but they nevertheless do not contradict the conclusion that the undesirably high absorption at 550 nm is a feature common to the benzoxazole coupounds having strong electron-withdrawing substituents on the hetero ring.

EXAMPLE 1B

A film punch of diameter 13 mm was taken from an unexposed filmstrip (from which the silver halide had been removed by bleaching and fixing) and placed in a flow cell. Color developer solution was pumped through the flow cell at a constant rate of 20 ml/min at 40° C. and the loss of coupler was followed using a spectrophotometer by monitoring the loss of density at 380 nm with time. From these data, half lives for the decomposition of the coupler were calculated. These data are given in Table I and show that compounds of the invention are more stable than the comparison compound which contains a benzoxazole having a strong electron-withdrawing substituent on the hetero ring.

EXAMPLE 2

Samples were prepared using Format 2 and were then exposed, processed, and evaluated as described in Example 1. Table II summarizes the results.

| Coating Format 2 | |
|---|---|
| Layer 2 | Gelatin 5.38 g/m$^2$<br>Hardener 1,1' - (methylene bis (sulfonyl))bis-ethene 2% of total gelatin<br>Spreading agent 1% of total volume |
| Layer 1 | Gelatin 2.69 g/m$^2$<br>Emulsion - tabular silver iodobromide 1.3 × 0.2μ, 4 mole % iodide at 0.40 g/m$^2$ Ag<br>+ Image Coupler at 0.39 (C-1) or 0.19 μM/m$^2$ for the high dye-yield couplers<br>Spreading agent 1% of total volume<br>Remjet or Grey Silver antihalation film base<br>Couplers dispersed in di-n-butyl phthalate. |

TABLE II

| Coupler | Change in Gamma versus C-1 | Dmax | Lambda Max | ½ BW | Relative Absorption at 550 nm |
|---|---|---|---|---|---|
| C-1 | — | 0.54 | 448 | 90 | 0.03 |
| I-1 | +0.54 | 1.03 | 449 | 92 | 0.03 |
| I-2 | +0.48 | 1.06 | 450 | 91 | 0.04 |
| I-3 | +0.54 | 1.11 | 449 | 91 | 0.03 |
| I-55 | +0.48 | 0.93 | 449 | 94 | 0.05 |
| I-56 | +0.34 | 0.88 | 451 | 93 | 0.05 |
| I-57 | +0.33 | 0.95 | 451 | 91 | 0.03 |
| I-58 | +0.71 | 1.16 | 450 | 91 | 0.03 |
| I-59 | +0.64 | 1.05 | 450 | 95 | 0.04 |

According to Table II, all of the inventive compounds show much higher reactivity as measured by gamma and $D_{max}$ than the comparison conventional coupler which was coated at twice the molar amount, and also showed a lambda max and half-band width comparable to the conventional coupler.

EXAMPLE 3

Photographic elements containing high dye-yield couplers were prepared in a multilayer film format. An ISO 400 speed set of coatings was prepared in which all layers except the blue light sensitive imaging layers were identical. The structures of these blue light sensitive layers are given below.

COATING 1. (CONTROL)

Layer 1: Upper, more blue light sensitive layer
- Gelatin 1.91 g/m$^2$
- C-1 0.22 g/m$^2$
- C-2 0.09 g/m$^2$
- B-1 0.005 g/m$^2$
- D-5 0.05 g/m$^2$
- CC-1 0.02 g/m$^2$
- Blue sensitized silver iodobromide emulsion A (0.23 g/m$^2$ Ag)
- Blue sensitized silver iodobromide emulsion B (0.57 g/m$^2$ Ag)

Layer 2: Lower, less blue light sensitive layer
- Gelatin 2.01 g/m$^2$
- C-1 0.7 g/m$^2$
- C-2 0.28 g/m$^2$
- B-1 0.003 g/m$^2$
- D-5 0.06 g/m$^2$
- CC-1 0.02 g/m$^2$
- Blue sensitized silver iodobromide emulsion C (0.64 g/m$^2$ Ag)
- Blue sensitized silver iodobromide emulsion D (0.23 g/m$^2$ Ag)

COATING 2 (INVENTION)

Layer 1:
As for coating 1 except omit C-1 and C-2 and substitute:
- I-1. 0.24 g/m$^2$
- Blue sensitized silver iodobromide emulsion A (0.23 g/m$^2$ Ag)
- Blue sensitized silver iodobromide emulsion B (0.29 g/m$^2$ Ag)

Layer 2:
As for coating 1 except omit C-1 and C-2 and substitute:
- Gelatin 1.91 g/m$^2$
- I-1 0.66 g/m$^2$
- Blue sensitized silver iodobromide emulsion C (0.32 g/m$^2$ Ag)
- Blue sensitized silver iodobromide emulsion D (0.11 g/m$^2$ Ag)

-continued

COATING 3 (INVENTION)

Layer 1:
As for coating 1 except omit C-1 and C-2 and substitute:
- I-2 0.21 g/m$^2$
- Blue sensitized silver iodobromide emulsion A (0.23 g/m$^2$ Ag)
- Blue sensitized silver iodobromide emulsion B (0.29 g/m$^2$ Ag)

Layer 2:
As for coating 1 except omit COMP-Y1 and COMP-Y2 and substitute:
- Gelatin 1.91 g/m$^2$
- I-2 0.63 g/m$^2$
- Blue sensitized silver iodobromide emulsion C (0.32 g/m$^2$ Ag)
- Blue sensitized silver iodobromide emulsion D (0.11 g/m$^2$ Ag)

The silver halide emulsions used in these experiments were as follows:

A—Tabular, 4.1 mole % I, 3.4×0.14 microns.

B—3D, 9 mole % I, 1.06 micron.

C—Tabular, 6 mole % I, 0.96×0.26 microns.

D—Tabular, 1.3 mole % I, 0.53×0.09 microns.

The remainder of the multilayer coating structure was composed of the following layers, applied in sequence to a transparent support of cellulose triacetate. The quantities of silver halide are given in g of silver per m$^2$. The quantities of other materials are given in g per m$^2$.

Layer A {Antihalation Layer} black colloidal silver sol containing 0.236 g of silver, with 2.44 g gelatin.

Layer B {First (least) Red-Sensitive Layer} Red sensitized silver iodobromide emulsion [1.3 mol % iodide, average grain diameter 0.55 microns, average thickness 0.08 microns] at 0.44 g, red sensitized silver iodobromide emulsion [4 mol % iodide, average grain diameter 1.0 microns, average thickness 0.09 microns] at 0.43 g, cyan dye-forming image coupler CC-1 at 0.48 g, cyan dye-forming masking coupler CM-1 at 0.033 g, BAR compound B-1 at 0.039 g, with gelatin at 1.83 g.

Layer C {Second (more) Red-Sensitive Layer} Red sensitive silver iodobromide emulsion [4 mol % iodide, average grain diameter 1.3 microns, average grain thickness 0.12 microns] at 0.72 g, cyan dye-forming image coupler CC-1 at 0.23 g, cyan dye-forming masking coupler CM-1 at 0.027 g, DIR compound D-1 at 0.011 g, with gelatin at 1.66 g.

Layer D {Third (most) Red-Sensitive Layer} Red sensitized silver iodobromide emulsion [4 mol % iodide, average grain diameter 2.6 microns, average grain thickness 0.13 microns] at 1.11 g, cyan dye-forming image coupler cyan-1 at 0.13 g, cyan dye-forming masking coupler CM-1 at 0.033 g, DIR compound D-1 at 0.013 g, DIR compound D-2 at 0.050 g, with gelatin at 1.36 g.

Layer E {Interlayer} Yellow dye material YD-1 at 0.11 g and 1.33 g of gelatin

Layer F {First (least) Green-Sensitive Layer} Green sensitized silver iodobromide emulsion [1.3 mol % iodide, average grain diameter 0.55 microns, average grain thickness 0.08 microns] at 0.54 g, green sensitized silver iodobromide emulsion [4 mol % iodide, average grain diameter 1.0 microns, average grain thickness 0.09 microns] at 0.28 g, magenta dye-forming image coupler M-1 at 0.26 g, magenta dye-forming masking coupler MM-1 at 0.067 g with gelatin at 1.78 g.

Layer G {Second (more) Green-Sensitive Layer} Green sensitized silver iodobromide emulsion [4 mol % iodide, average grain diameter 1.25 microns, average grain thickness 0.12 microns] at 1.00 g, magenta dye-forming image coupler M-1 at 0.081 g, magenta dye-forming masking coupler MM-1 at 0.067 g, DIR compound D-1 at 0.024 g with gelatin at 1.48 g.

Layer H {Third (most) Green-Sensitive Layer} Green sensitized silver iodobromide emulsion [4 mol % iodide, average grain diameter 2.19 microns, average grain thickness 0.13 microns] at 0.97 g, magenta dye-forming image coupler M-1 at 0.062 g, magenta dye-forming masking coupler MM-1 at 0.056 g, DIR compound D-3 at 0.011 g, DIR compound D-4 at 0.011 g, with gelatin at 1.33 g.

Layer I {Interlayer} Yellow dye material YD-2 at 0.11 g with 1.33 g gelatin. The blue sensitive layers were coated at this point. Layer 2 then Layer 1. Layer J was then coated above the blue light sensitive layers.

Layer J {Protective Layer} 0.111 g of dye UV-1, 0.111 g of dye UV-2, unsensitized silver bromide Lippman emulsion at 0.222 g, 2.03 g.

This film was hardened at coating with 2% by weight to total gelatin of hardener H-1. Surfactants, coating aids, scavengers, soluble absorber dyes and stabilizers were added to the various layers of this sample as is commonly practiced in the art.

The multilayer samples were subjected to the standard wedge exposure and processsed in accordance with the Kodak Flexicolor C-41 process. The multilayer was subjected to acutance testing by performing a modulation transfer function (MTF) experiment, outlined in James T. H.; The Theory of the Photographic Process; 4th Ed., Ch. 21, the following MTF measurements were obtained.

Table III shows comparative sensitometric data and the good effects on the acutance of the underlying (green and red light sensitive) layers.

TABLE III

| | COATING | | |
|---|---|---|---|
| | 1 | 2 | 3 |
| | TYPE | | |
| | COMPARISON | INVEN-TION | INVEN-TION |
| SILVER LOAD | 100% | 57% | 57% |
| COUPLER LOAD | 100% | 67% | 65% |
| BLUE $D_{min}$ | 0.78 | 0.81 | 0.86 |
| BLUE GAMMA | | | |
| LOWER SCALE | 100% | 131% | 130% |
| MID SCALE | 100% | 117% | 111% |
| UPPER SCALE | 100% | 103% | 111% |
| SENSITIVITY | 100% | 91% | 89% |
| $D_{max}$ | 3.03 | 3.05 | 3.15 |
| GREEN LAYER MTF AT 20 cpmm, | | | |
| SEPARATION: | 71% | 85% | 84% |

TABLE III-continued

| | COATING | | |
|---|---|---|---|
| | 1 | 2 | 3 |
| | TYPE | | |
| | COMPARISON | INVEN-TION | INVEN-TION |
| NEUTRAL: RED LAYER MTF AT20 cpmm, | 104% | 111% | 108% |
| SEPARATION: | 38% | 53% | 50% |
| NEUTRAL: | 66% | 76% | 76% |

Table III demonstrates that the inventive coatings, while having a much lower silver halide and coupler loading than the comparison, show more than equivalent dye formation versus the comparison (measured as gamma and $D_{max}$ increases). The changes in $D_{min}$ are very small and the changes in sensitivity are surprisingly small considering the large reduction in the quantity of silver halide coated (35% less than in the comparison).

The lower loading of the blue light sensitive layers also leads to layer thinning, estimated to be a reduction of 0.8 micrometers. This lower silver level and thinning result in less degradation of acutance in the green and red records. Considerable increases in acutance are seen in those layers when given either a neutral (white light) or a separation (red or green light) exposure.

The formulas for conventional imaging couplers (C-1 and C-2) employed in the blue sensitive layers of the multilayer of Example 3 and for the various film layers were as follows:

C-1

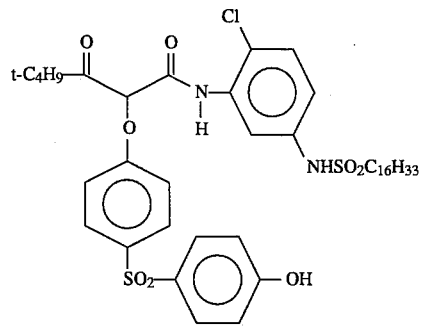

C-2

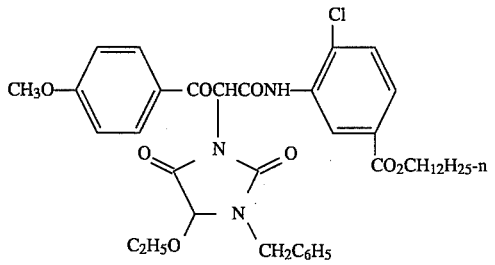

The formulas for the component materials are as follows:

CC-1:
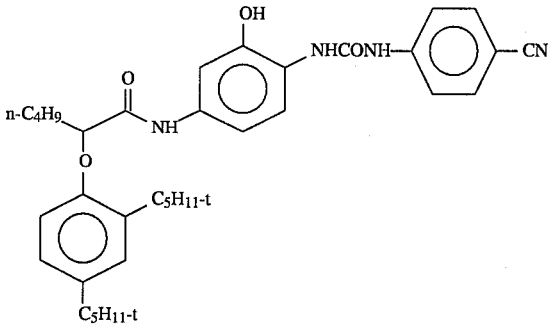
CM-1
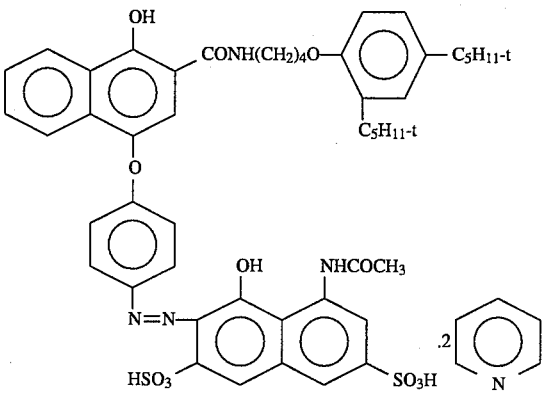
B-1
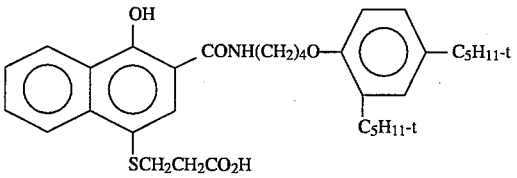
D-1:
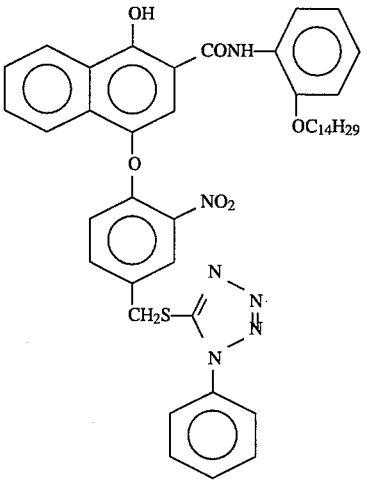
D-2

-continued
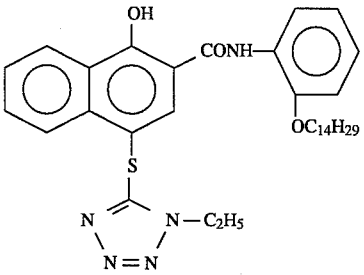
D-3:
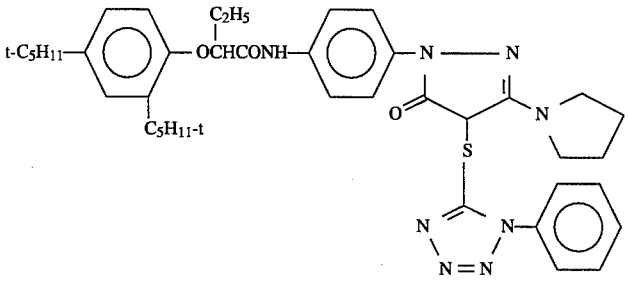
D-4
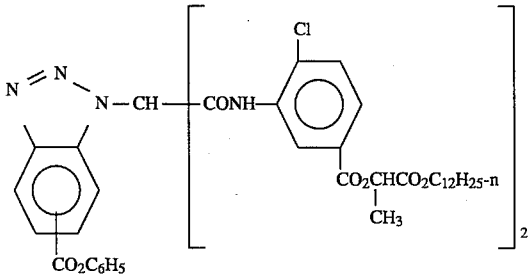
D-5:
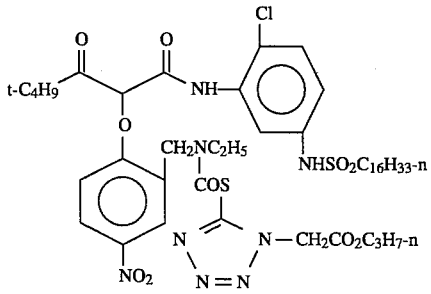
D-6:
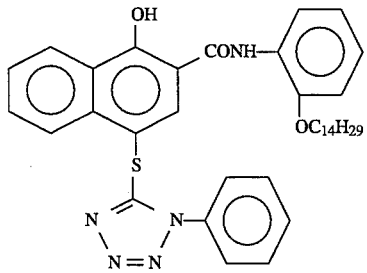
MM-1

-continued
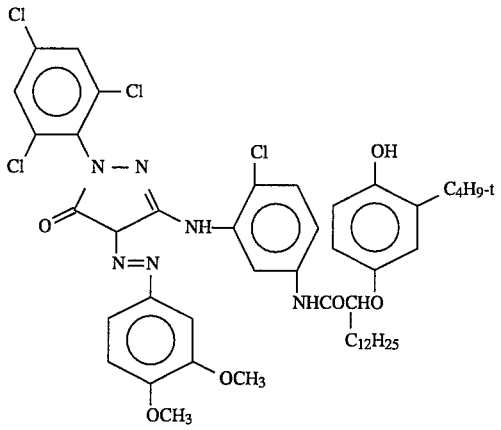
M-1:
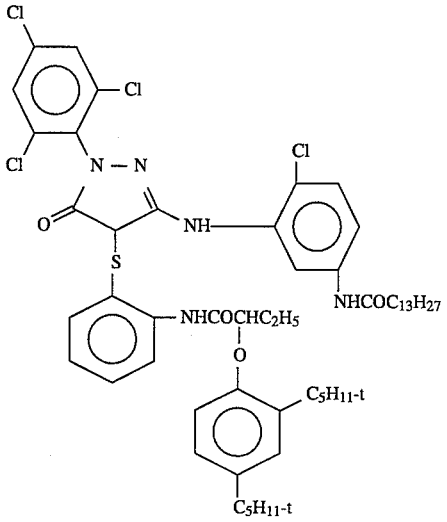
YD-1:
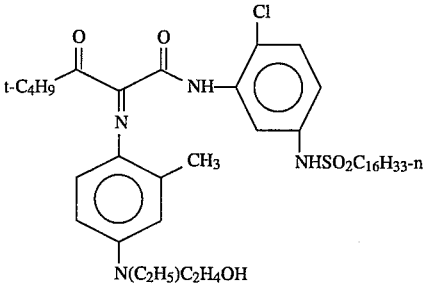
YD-2:
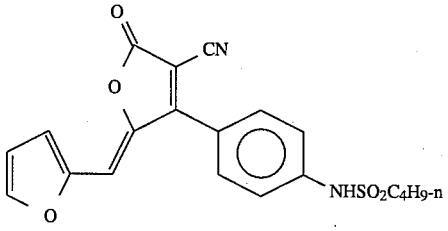
UV-1:
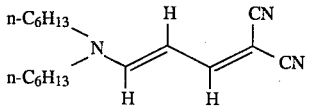

-continued

UV-2:

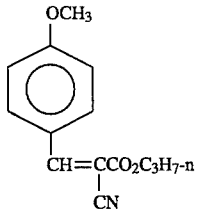

H-1:
$CH_2(SO_2CHCH_2)_2$

EXAMPLE 4

This example uses Coating Format 1 and shows sensitometric comparisons between couplers of the invention releasing methine dyes versus a conventional yellow coupler and a coupler releasing an azo dye. These comparisons demonstrate the superior performance of the compounds of the invention. The formula for the comparative azo releasing coupler was as follows:

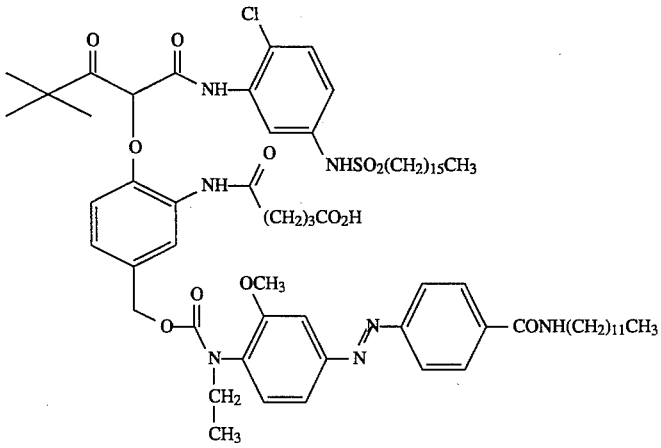

CHDY-4

TABLE IV

| Coupler | ΔGamma vs C-1 | $D_{max}$ | $\lambda_{max}$ | Half Bandwidth |
|---|---|---|---|---|
| C-1 | — | 0.68 | 448 | 90 |
| CHDY-4 | 0.02 | 0.66 | 442 | 106 |
| I-63 | 0.22 | 0.96 | 453 | 94 |
| I-64 | 0.20 | 0.97 | 450 | 92 |
| I-49 | 0.36 | 1.05 | 451 | 92 |
| I-50 | 0.17 | 0.84 | 449 | 92 |
| I-65 | 0.33 | 0.99 | 449 | 91 |

Table IV shows that, when coated at equimolar laydowns, the inventive methine dye-releasing couplers give higher gamma and $D_{max}$ values than the comparative azo dye-releasing high dye-yield coupler. Moreover, the couplers of the invention provide values for the maximum absorption wavelength and bandwidth which approach those of the conventional coupler far more closely.

The preceding examples are set forth to illustrate specific embodiments of this invention and are not intended to limit the scope of the materials or combinations of this invention. Additional embodiments and advantages within the scope of the claimed invention will be apparent to one skilled in the art. All previously cited patents, publications, and cofiled and copending patent applications are incorporated herein by reference in their entirety.

What is claimed is:

1. A photographic element comprising a substrate bearing a photographic silver halide emulsion layer having associated therewith a high dye-yield coupler having the formula:

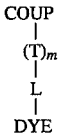

wherein:

COUP is a photographic coupler residue capable of coupling with oxidized color developer to form a first dye;

T is a timing group;

m is an integer from 0 to 2;

L is a linking group selected from the group consisting of —OC(=O)—, —OC(=S)—, —SC(=O)—, —SC(=S)—, and —OC(=$NSO_2R$) where R is substituted or unsubstituted alkyl or aryl;

DYE is a releasable second dye or dye precursor, wherein DYE has the formula:

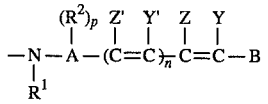

wherein $R^1$ is hydrogen or a substituted or unsubstituted alkyl, aryl or heteroaryl group;

A is a substituted or unsubstituted aryl or heteroaryl ring;

each $R^2$ is independently a substituted or unsubstituted alkyl group which may form a ring with Z';

p is an integer from 0 to 3;

each Z, Z', and Y' is independently hydrogen or a substituent;

Y is an electron withdrawing group;

n is 0, 1, or 2; and

B is a heterocycle having the formula:

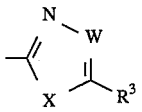

wherein:

X is O, S, or $N(R^5)$ where $R^5$ is hydrogen or alkyl;

W is N or $C(R^4)$ where $R^4$ is hydrogen or a substituent;

$R^3$ is a substituent linked to the heterocycle by a carbon or nitrogen atom of the substituent;

provided that $R^3$ and $R^4$ may be linked to form a ring and provided further that when $R^3$ and $R^4$ form a phenyl ring, Z is hydrogen, W is C(R4), and X is oxygen, the phenyl ring does not contain a substituent having a Hammett's sigma(para) value of 0.23 or more.

2. The element of claim 1 wherein X is O.

3. The element of claim 1 wherein $R^3$ is an alkyl or aryl group.

4. The element of claim 1 wherein $R^3$ and $R^4$ are joined to form a ring.

5. The element of claim 4 wherein the ring formed by $R^3$ and $R^4$ is a substituted or unsubstituted aromatic ring.

6. The element of claim 5 wherein said aromatic ring is selected from the group consisting of substituted and unsubstituted phenyl and naphthyl rings.

7. The element of claim 6 wherein said aromatic ring is a substituted or unsubstituted phenyl ring.

8. The element of claim 7 wherein the phenyl ring contains at least one alkyl substituent.

9. The element of claim 8 wherein said substituent contains up to 8 carbon atoms.

10. The element of claim 8 wherein said substituent is selected from methyl and i-propyl, and t-butyl groups.

11. The element of claim 8 wherein said phenyl ring contains two methyl substituents.

12. The element of claim 11 wherein said two methyl substituents are at the 4- and 6-positions.

13. The element of claim 1 wherein m is 0.

14. The element of claim 1 wherein m is 1 or 2 and at least one T has the formula:

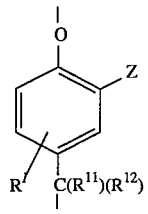

wherein Z is selected from the group consisting of nitro, cyano, alkylsulfonyl; sulfamoyl ($—SO_2NR_2$); and sulfonamido ($—NRSO_2R$) groups; R is hydrogen or a substituent such as alkyl; $R^7$, $R^{11}$ and $R^{12}$ are independently hydrogen or substituents that do not adversely affect the coupling and release reactions or the properties of the dyes formed thereby.

15. The element of claim 14 wherein m is 2.

16. The element of claim 1 wherein L is —OC(=O)—.

17. The element of claim 1 wherein Y is an electron withdrawing group having a Hammett's sigma(para) value of at least 0.3.

18. The element of claim 1 wherein Y is selected from the group consisting of cyano, carboxyl, sulfonyl and acyl.

19. The element of claim 1 wherein $R^1$ is a substituted or unsubstituted alkyl or aryl group.

20. The element of claim 19 wherein said substituted or unsubstituted alkyl or aryl group contains up to 42 carbon atoms.

21. The element of claim 20 wherein said group is a substituted or unsubstituted alkyl group which contains up to 22 carbon atoms.

22. The element of claim 21 wherein said substituted or unsubstituted alkyl group is selected from the group consisting of methyl, ethyl, propyl, propanoic, butyl, pentyl, and dodecyl.

23. The element of claim 19 wherein $R^1$ is a cyclic or branched alkyl group.

24. The element of claim 23 wherein said alkyl group contains from 1 to 6 carbon atoms.

25. The element of claim 24 wherein said alkyl group is selected from the group consisting of isopropyl, cyclopentyl, and cyclohexyl.

26. The element of claim 1 wherein A is a phenyl or naphthyl ring.

27. The element of claim 26 wherein p is at least 1.

28. The element of claim 27 wherein A contains at least one methyl or propyl group as an $R^2$.

29. The element of claim 1 wherein A is a thiazole five-membered ring.

30. The element of claim 1 wherein COUP is of a formula that forms a yellow dye upon coupling with oxidized color developer.

31. The element of claim 1 wherein COUP is of a formula that forms a colorless dye upon coupling with oxidized color developer.

32. The element of claim 31 wherein COUP is of a formula that forms a colorless dye which will wash out of the element during processing upon coupling with oxidized color developer.

33. The element of claim 1 wherein X is O, W is $C(R^4)$, and $R^3$ and $R^4$ form a phenyl ring.

34. A process of forming an image comprising processing the element of claim 1, which has been exposed image-wise, by contacting the element with oxidized color developer.

35. A photographic element comprising a substrate bearing a photographic silver halide emulsion layer having associated therewith a high dye-yield coupler having the formula:

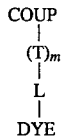

wherein:

COUP is a photographic coupler residue capable of coupling with oxidized color developer to form a first dye;

T is a timing group;

m is an integer from 0 to 2;

L is a linking group selected from the group consisting of —OC(=O)—, —OC(=S)—, —SC(=O)—, —SC(=S)—, and —OC(=$NSO_2R$) where R is substituted or unsubstituted alkyl or aryl;

DYE is a releasable second dye or dye precursor, wherein DYE has the formula:

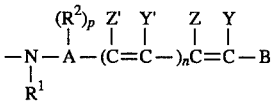

wherein $R^1$ is hydrogen or a substituted or unsubstituted alkyl, aryl or heteroaryl group;

A is a substituted or unsubstituted aryl or heteroaryl ring;

each $R^2$ is independently a substituted or unsubstituted alkyl group which may form a ring with Z';

p is an integer from 0 to 3;

each Z, Z', and Y' is independently hydrogen or a substituent;

Y is an electron withdrawing group;

n is 0, 1, or 2; and

B is a heterocycle having the formula:

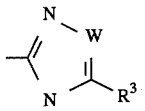

wherein:

X is O, S, or N($R^5$) where $R^5$ is hydrogen or alkyl;

W is C($R^4$) where $R^4$ is hydrogen or a substituent;

$R^3$ is a substituent linked to the heterocycle by a carbon or nitrogen atom of the substituent;

provided that $R^3$ and $R^4$ may be linked to form a ring and provided further that when $R^3$ and $R^4$ form a phenyl ring, Z is hydrogen, W is C($R^4$), and X is oxygen, the phenyl ring does not contain a substituent having a Hammett's sigma(para) value of 0.23 or more.

36. The element of claim 35 wherein X is O.

37. The element of claim 35 wherein $R^3$ is an alkyl or aryl group.

38. The element of claim 35 wherein $R^3$ and $R^4$ are joined to form a ring.

39. The element of claim 38 wherein the ring formed by $R^3$ and $R^4$ is a substituted or unsubstituted aromatic ring.

40. The element of claim 39 wherein said aromatic ring is selected from the group consisting of substituted and unsubstituted phenyl and naphthyl rings.

41. The element of claim 40 wherein said aromatic ring is a substituted or unsubstituted phenyl ring.

42. The element of claim 41 wherein the phenyl ring contains at least one alkyl substituent.

43. The element of claim 42 wherein said substituent contains up to 8 carbon atoms.

44. The element of claim 43 wherein said substituent is selected from methyl and i-propyl, and t-butyl groups.

45. The element of claim 42 wherein said phenyl ring contains two methyl substituents.

46. The element of claim 45 wherein said two methyl substituents are at the 4- and 6-positions.

47. The element of claim 35 wherein m is 0.

48. The element of claim 35 wherein m is 1 or 2 and at least one T has the formula:

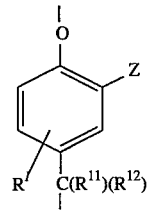

wherein Z is selected from the group consisting of nitro, cyano, alkylsulfonyl; sulfamoyl (—$SO_2NR_2$); and sulfonamido (—$NRSO_2R$) groups; R is hydrogen or a substituent such as alkyl; $R^7$, $R^{11}$ and $R^{12}$ are independently hydrogen or substituents that do not adversely affect the coupling and release reactions or the properties of the dyes formed thereby.

49. The element of claim 48 wherein m is 2.

50. The element of claim 35 wherein L is —OC(=O)—.

51. The element of claim 35 wherein Y is an electron withdrawing group having a Hammett's sigma(para) value of at least 0.3.

52. The element of claim 35 wherein Y is selected from the group consisting of cyano, carboxyl, sulfonyl and acyl.

53. The element of claim 35 wherein $R^1$ is a substituted or unsubstituted alkyl or aryl group.

54. The element of claim 53 wherein said substituted or unsubstituted alkyl or aryl group contains up to 42 carbon atoms.

55. The element of claim 54 wherein said group is a substituted or unsubstituted alkyl group which contains up to 22 carbon atoms.

56. The element of claim 55 wherein said substituted or unsubstituted alkyl group is selected from the group consisting of methyl, ethyl, propyl, propanoic, butyl, pentyl, and dodecyl.

57. The element of claim 53 wherein $R^1$ is a cyclic or branched alkyl group.

58. The element of claim 57 wherein said alkyl group contains from 1 to 6 carbon atoms.

59. The element of claim 58 wherein said alkyl group is selected from the group consisting of isopropyl, cyclopentyl, and cyclohexyl.

60. The element of claim 35 wherein A is a phenyl or naphthyl ring.

61. The element of claim 60 wherein p is at least 1.

62. The element of claim 61 wherein A contains at least one methyl or propyl group as an $R^2$.

63. The element of claim 35 wherein A is a thiazole five-membered ring.

64. The element of claim 35 wherein COUP is of a formula that forms a yellow dye upon coupling with oxidized color developer.

65. The element of claim 35 wherein COUP is of a formula that forms a colorless dye upon coupling with oxidized color developer.

66. The element of claim 65 wherein COUP is of a formula that forms a colorless dye which will wash out of the element during processing upon coupling with oxidized color developer.

67. The element of claim 35 wherein X is O, W is $C(R^4)$, and $R^3$ and $R^4$ form a phenyl ring.

* * * * *